US009709220B2

(12) United States Patent
Zhang et al.

(10) Patent No.: US 9,709,220 B2
(45) Date of Patent: Jul. 18, 2017

(54) METHOD FOR CONSTRUCTING UNIVERSAL LED BULB AND SNAP RING LENS TYPE LED BULB AND LED LAMP

(71) Applicant: GUIZHOU GZGPS CO., LTD, Guiyang, Guizhou (CN)

(72) Inventors: Jiqiang Zhang, Guizhou (CN); Zheyuan Zhang, Guizhou (CN)

(73) Assignee: GUIZHOU GZGPS CO., LTD., Guizhou (CN)

( * ) Notice: Subject to any disclaimer, the term of this patent is extended or adjusted under 35 U.S.C. 154(b) by 19 days.

(21) Appl. No.: 14/416,497

(22) PCT Filed: Jul. 23, 2013

(86) PCT No.: PCT/CN2013/000882
§ 371 (c)(1),
(2) Date: Jan. 22, 2015

(87) PCT Pub. No.: WO2014/015658
PCT Pub. Date: Jan. 30, 2014

(65) Prior Publication Data

US 2015/0192253 A1 Jul. 9, 2015

(30) Foreign Application Priority Data

Jul. 23, 2012 (CN) ..... 2012 1 0253596
Jul. 23, 2012 (CN) ..... 2012 1 0253600
(Continued)

(51) Int. Cl.
*F21K 99/00* (2016.01)
*F21S 8/00* (2006.01)
(Continued)

(52) U.S. Cl.
CPC ..... *F21K 9/135* (2013.01); *F21K 9/20* (2016.08); *F21K 9/232* (2016.08); *F21K 9/60* (2016.08);
(Continued)

(58) Field of Classification Search
CPC ..... F21V 17/06; F21V 29/50; F21V 29/70; F21V 29/74; F21V 15/01; F21V 21/03;
(Continued)

(56) References Cited

FOREIGN PATENT DOCUMENTS

CN 201582630 U 9/2010
CN 201582681 U 9/2010
(Continued)

OTHER PUBLICATIONS

Search Report issued in International Application No. PCT/CN2013/000882, eight (8) pages.

*Primary Examiner* — Mary Ellen Bowman
(74) *Attorney, Agent, or Firm* — Nath, Goldberg & Meyer; Joshua B. Goldberg; Christopher Thomas

(57) ABSTRACT

The present invention provides a method for constructing a universal LED bulb (102), a snap ring lens type LED bulb (102) and a lamp. The constructing method includes: supporting an optical engine core member of the LED bulb using a lens snap ring (8) as the supporting main body, using a light distribution optical lens (7) as an auxiliary supporting structure, and further using the light distribution optical lens (7) as an installation base of the optical engine core member, or using the light distribution optical lens (7) as an installation base of an LED bulb radiator (103) in cooperation with an inner snap ring (81), wherein an installation flange is provided to the lens snap ring (8) for installing the LED bulb (102). The LED bulb (102) may be provided with the radiator (103) to independently work and may also be installed on the radiator (103) of the lamp.

22 Claims, 41 Drawing Sheets

(30) Foreign Application Priority Data

| | | |
|---|---|---|
| Jul. 23, 2012 | (CN) | 2012 1 0253701 |
| Jul. 23, 2012 | (CN) | 2012 1 0253819 |
| Jul. 23, 2012 | (CN) | 2012 1 0253834 |
| Jul. 23, 2012 | (CN) | 2012 1 0253841 |
| Jul. 23, 2012 | (CN) | 2012 1 0253842 |
| Jul. 23, 2012 | (CN) | 2012 1 0255564 |

(51) Int. Cl.

| | |
|---|---|
| ***F21K 9/90*** | (2016.01) |
| ***F21V 29/74*** | (2015.01) |
| ***F21V 17/00*** | (2006.01) |
| ***F21V 23/06*** | (2006.01) |
| ***F21K 9/20*** | (2016.01) |
| ***F21K 9/232*** | (2016.01) |
| ***F21K 9/60*** | (2016.01) |
| *F21V 15/01* | (2006.01) |
| *F21V 29/76* | (2015.01) |
| *F21V 29/83* | (2015.01) |
| *F21Y 115/10* | (2016.01) |

(52) U.S. Cl.
CPC *F21K 9/90* (2013.01); *F21S 8/00* (2013.01); *F21V 17/00* (2013.01); *F21V 23/06* (2013.01); *F21V 29/74* (2015.01); *F21V 15/01* (2013.01); *F21V 29/76* (2015.01); *F21V 29/83* (2015.01); *F21Y 2115/10* (2016.08); *Y10T 29/41* (2015.01)

(58) Field of Classification Search
CPC ..... F21V 21/30; F21V 31/00; F21K 9/135; F21K 9/30; F21S 8/00
See application file for complete search history.

(56) References Cited

FOREIGN PATENT DOCUMENTS

| | | | |
|---|---|---|---|
| CN | 102777799 | A | 11/2012 |
| CN | 102777825 | A | 11/2012 |
| CN | 102777831 | A | 11/2012 |
| CN | 102777839 | A | 11/2012 |
| CN | 102798008 | A | 11/2012 |
| CN | 102818173 | A | 12/2012 |
| CN | 102818177 | A | 12/2012 |
| CN | 102818184 | A | 12/2012 |
| JP | 2012133964 | A | 7/2012 |
| KR | 20110003510 | U | 4/2011 |

METHOD FOR CONSTRUCTING UNIVERSAL LED BULB AND SNAP RING LENS TYPE LED BULB AND LED LAMP

This is a National Phase Application filed under 35 U.S.C. 371 as a national stage of PCT/CN2013/000882, filed Jul. 23, 2013, and claims priority benefit from Chinese Application No. 201210255564.0, filed Jul. 23, 2012, Chinese Application No. 201210253701.7, filed Jul. 23, 2012, Chinese Application No. 201210253600.X, filed Jul. 23, 2012, Chinese Application No. 201210253834.4, filed Jul. 23, 2012, Chinese Application No. 201210253596.7, filed Jul. 23, 2012, Chinese Application No. 201210253841.4, filed Jul. 23, 2012, Chinese Application No. 201210253819.X, filed Jul. 23, 2012, Chinese Application No. 201210253842.9, filed Jul. 23, 2012, the content of each of which is hereby incorporated by reference in its entirety.

FIELD OF THE INVENTION

The present invention relates to a method for constructing a universal LED bulb, a snap ring lens type LED bulb and an LED lamp, which involve the field of LED lighting technology.

BACKGROUND OF THE INVENTION

As a new generation of lighting technology, LED semiconductor lighting has five energy-saving advantages incomparable by the existing other lighting technologies, such as high photoelectric conversion efficiency, easy control of light source direction, easy control of lighting time and manner, high light source color rendering property, and a high power factor under reasonable design, thus being warmly welcomed by worldwide investors and vigorously supported by the governments of all countries. The luminous efficiency of most current LED lamps may exceed 70 LM/W, thus having better energy saving advantages than the traditional energy saving lamps. The luminous efficiency of green LEDs may be up to 683 LM/W theoretically; the theoretical efficiency of white LED is also up to 182.45 LM/W, so the improvement space of LED lighting efficiency is huge.

In the current design of high power LED lighting products, especially high power LED lamps, due to heat dissipation, when a high power LED lamp is assembled, an LED light module, a driving power supply and a lamp are integrally designed, namely such components as the LED light module, the driving power supply and the lamp must be produced collectively, thus forming a so-called situation of "LED having lamp while lacking bulb". This brings a series of fatal problems to the LED lighting products, such as high manufacturing cost, inconvenience for use, difficulty in maintenance, and the like. First of all, national and even global uniform standardized production could not be achieved on manufacture, leading to numerous product specifications, few batches and high prices; second, the products of producers are varied, not universal, let alone interchangeable; third, the LED light module, the driving power supply, the lamp and the like need to be integrally detached for maintenance in the case of product failure, thus the maintenance is very inconvenient, and such defects as expanded failure, delayed maintenance and high maintenance cost and the like are very liable to form. These defects greatly restrict the popularization and use of LED lighting and are inherent problems in the popularization of the LED lighting products.

SUMMARY OF THE INVENTION

The object of the present invention is to provide a method for constructing a universal LED bulb, a snap ring lens type LED bulb and an LED lamp. The LED bulb is simple and stable in structure, convenient to install, capable of being provided with a radiator to independently operate and may also be installed on the radiator of the lamp, thus being used flexibly. By adopting the present invention, the LED bulb is independently produced and used with such products as lamp and lighting control and the like on production, thereby greatly reducing manufacturing links of the LED lighting products, improving mass production and facilitating the industrialization of LED energy-saving lighting products.

The technical solutions of the present invention are as follows: a method for constructing a universal LED bulb, comprising: supporting an optical engine core member of the LED bulb using a lens snap ring as a supporting main body of the bulb, and using a light distribution optical lens as an auxiliary supporting structure of the bulb, and further using the light distribution optical lens as an installation base of the LED bulb optical engine core member or using the light distribution optical lens as an installation base of an LED bulb radiator in cooperation with an inner snap ring, wherein an installation flange is provided to the lens snap ring for installing the bulb; the optical engine core member of the LED bulb is composed of a heat conductive bracket, an optical engine module, the inner snap ring and the light distribution optical lens, wherein an inner cover is provided outside the optical engine module, and an electric connector is provided to the heat conductive bracket; the optical engine module is made up of an optical engine die plate, an LED chip set and a relevant wiring by bonding and packaging, or is further integrated with a power supply drive chip. The optical engine die plate is a normalized heat conductive substrate. How to explain "normalized"?

In the above-mentioned method for constructing the universal LED bulb, the diameter of the lens snap ring is a bulb outer diameter D, the bulb outer diameter D and an upper limit of power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outer diameters D, in order to improve interchangeability and universality of the LED bulbs; on the relationship curve $W=1.1812e^{0.0361D}$, with 20 mm used as a lower limit of the bulb outer diameter D and 130 mm used as an upper limit, the relationship curve is divided into 12 segments each of which is set to 10 mm to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D. The installation interface of the LED bulb includes a surface in contact with the LED bulb and a hole connected to the LED bulb on the lamp.

In the foregoing method for constructing the universal LED bulb, a groove with a step is provided in the light distribution optical lens, and an integral structure in which the heat conductive bracket is combined with the optical engine module is adhered in the step, or, an inner snap ring further surrounds the optical engine module, or an inner ring cover is further provided between the groove edge of the light distribution optical lens and the inner cover, such that the optical engine module is enclosed in a sealed waterproof space between the light distribution optical lens and the heat conductive bracket; or the inner snap ring cooperates with the light distribution optical lens to be used as an installation base of the LED bulb radiator, an upper end of the inner snap ring is adhered to the heat conductive bracket, a lower end thereof is provided with a radiator fixing through hole, a pressure pad is provided inside the fixing through hole to prevent water and for preventing a radiator fixing screw from crushing the heat conductive bracket; the thicknesses of the light distribution optical lens and the heat conductive bracket are adjusted to enable the heat conductive bracket to tightly abut on the radiator when the lens snap ring is installed; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. Due to this structure, the structure between the LED light source chip and the radiator is simpler, heat generated by the chip will be quickly transferred to the optical engine die plate for dispersion, thus being conducive to cool the LED chip and prolong the service life of the LED light source.

In the foregoing method for constructing the universal LED bulb, a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by low temperature extrusion moulding and high temperature sintering of an ultrafine nonmetal heat conductive material (such as alumina, silicon carbide or the like with a mesh number of fineness smaller than 300), contact surfaces of the nonmetal radiator and the heat conductive conversion bracket are adhered into an integral piece by being coated with a heat conductive adhesive, the heat conductive conversion bracket is overhead, the nonmetal radiator has a screen mesh structure, and the nonmetal radiator is kept overhead by the heat conductive conversion bracket, so that air can enter the screen meshes of the nonmetal radiator from the heat conductive conversion bracket. A rubber sheath or screw fixing glue is filled in the fixing screw hole of the nonmetal radiator for connecting a fixing screw, and a radiator outer cover (which may be made by stamping metal material or die-casting plastics to beautify the appearance of the bulb) is provided outside the nonmetal radiator; or the radiator is a metal radiator, the heat conductive pad is provided between the metal radiator and the heat conductive bracket, the metal radiator has a hollow structure, a foam metal is filled in the hollow part, superconductive liquid is filled in the hollow structure, upper and lower stoppers are pressed by interference fit or screwed by a threaded seal gum into the hollow structure to form a sealed space, and the sealed space is vacuumized; the fixing screw of the radiator penetrates through a fixing through hole on the inner snap ring, to be connected to the fixing screw hole of the nonmetal radiator or the metal radiator.

In the foregoing method for constructing the universal LED bulb, fluorescent powder is spray-coated on the LED chip on the optical engine module, and transparent silica gel is covered thereon; or the number of the LED chips is configured according to the proportion of blue and red lights necessary for plants, and only the transparent silica gel is covered on the welded LED chip for package; or, the LED chip on the optical engine module is merely packaged by the transparent silica gel, and then, an inner cover coated with fluorescent powder on its inner side is provided outside the packaged optical engine module; or no silica gel is covered on the LED chip on the optical engine module, a concave inner cover filled with transparent insulating heat conductive liquid is provided outside the optical engine module, the fluorescent powder is provided in the transparent insulating heat conductive liquid, and the concave inner cover is an elastic inner cover of a thin concave structure.

The fluorescent powder is spray-coated on the LED chip on the optical engine module, and the transparent silica gel is covered thereon; or the number of the LED chips on the optical engine module is configured according to the proportion of blue and red lights necessary for plants, and only the transparent silica gel is covered on the welded LED chip; or, the LED chip on the optical engine module may also be packaged by the traditional package solution, namely, the fluorescent powder is spray-coated on the LED chip and the transparent silica gel is covered thereon with no inner cover; when the present invention is applied to agricultural production lighting, the number of the LED chips on the optical engine module is configured according to the proportion of blue and red lights necessary for plants, and the welded LED chip is covered only by the transparent silica gel.

In the foregoing method for constructing the universal LED bulb, the LED chip on the optical engine module is packaged by transparent silica gel, then the inner cover coated with fluorescent powder on the inner side is provided outside the packaged optical engine module, in which the fluorescent powder is more uniform compared with a case that it is directly spray-coated on the chip. The fluorescent powder is away from the LED heating chip, the LED chip may operate at a relatively higher temperature, thereby improving the LED operation condition, effectively reducing the luminous decay of the LED bulb and ensuring a better LED light emission effect, and the dosage of the fluorescent powder is not greatly increased; or no silica gel is covered on the LED chip of the optical engine module, the concave inner cover filled with transparent insulating heat conductive liquid is provided outside the optical engine module, the fluorescent powder is provided in the transparent insulating heat conductive liquid, and the concave inner cover is an elastic inner cover of a thin concave structure. In this structure, when the LED is energized to generate heat, the transparent insulating heat conductive liquid flows due to being heated to take away the heat of the LED chip, in order to exchange the heat with the radiator on a larger area, whereby avoiding local high heat of the LED chip and the surrounding fluorescent powder in the traditional solution and effectively reducing the occurrence of LED luminous decay, and when the transparent insulating heat conductive liquid is expanded due to being heated, the concave inner cover protrudes outwards to increase the volume for receiving the expanded liquid, in order to prevent ineffective sealing of the inner cover by the expansion of the liquid.

In the foregoing method for constructing the universal LED bulb, a connector plug fixing hole is provided to the heat conductive bracket, a connector plug with a contact pin is inserted into the connector plug fixing hole and is fixed with the part inserted into the bulb as a fixed end, the tail end of the contact pin is welded to the optical engine die plate in the universal LED bulb to form a simple electrical interface on the outer surface of the universal LED bulb, and during installation, electrical connection of the universal LED bulb is achieved as long as the connector plug is in butt-joint with the connector socket with a cable and the universal LED bulb is fixed; an eccentric position of the connector plug fixing hole on the heat conductive bracket and a size of the fixed end of the connector plug are defined, such that the optical engine die plate in the LED bulb may meet the demands of arranging the LED chip and the power supply drive chip and registering them; the connector plug with the contact pin is of a four-pin structure, in which two pins are used for power supply access and the other two pins are used for control access; the fixed end is formed in a nut fixing manner or a fusion ring fixing manner; when the fixed end is formed in the nut fixing manner, a waterproof rubber ring is added between the connector plug and the heat conductive bracket to prevent water; in order to prevent rotation, an antiskid groove is provided in the connector plug, and a corresponding projection is provided at the through hole of the heat conductive bracket; a three-hole flange is provided to the connector socket and is fixed to the lamp radiator through a fixing screw, and an adjusting rubber pad is provided between the connector socket and the radiator to adjust its thickness in order to ensure the tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

A snap ring lens type LED bulb constructed by the foregoing method, includes a lens snap ring with an installation flange, wherein at least a heat conductive bracket, an optical engine module and a light distribution optical lens are provided inside the lens snap ring sequentially, a groove with a step is provided on the light distribution optical lens, the heat conductive bracket is adhered in the step, the optical engine module is adhered on the heat conductive bracket, a connector plug is fixed to the heat conductive bracket, an inner cover is provided outside the optical engine module, or an inner ring cover may be further provided between the groove edge of the light distribution optical lens and the inner cover, the optical engine module is enclosed in a sealed waterproof space between the heat conductive bracket and the light distribution optical lens, and when the lens snap ring is installed, it can be ensured an upper surface of the heat conductive bracket is closely attached to the radiator; or, an inner snap ring surrounds the optical engine module, an upper part of the inner snap ring is adhered to the heat conductive bracket, a lower end thereof is provided with a radiator fixing through hole, a pressure pad is provided in the fixing through hole to prevent water and for preventing a radiator fixing screw from crushing the heat conductive bracket; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate, in which a circuit is embedded by silver paste printed circuit technology.

In the foregoing snap ring lens type LED bulb, a radiator is provided to the heat conductive bracket; the radiator is a nonmetal radiator assembly, the nonmetal radiator assembly includes a nonmetal radiator and an overhead heat conductive conversion bracket at the lower side thereof, a rubber sheath or screw fixing glue is filled in the radiator fixing screw hole of the nonmetal radiator for connecting a fixing screw, and a radiator outer cover is provided outside the nonmetal radiator; or the radiator is a metal radiator, a heat conductive pad is provided between the metal radiator and the heat conductive bracket, the metal radiator includes a cooling fin, a superconductive fluid cavity is provided at the middle of the cooling fin, a foam metal is filled in the superconductive fluid cavity and superconductive fluid is filled therein, an upper stopper and a lower stopper are provided on both ends of the superconductive fluid cavity, and a vacuum suction pipe is provided to the upper stopper or the lower stopper; a cable hole used for penetration of a cable and a radiator fixing screw hole are further provided to the radiator, a radiator fixing screw connected to the radiator fixing screw hole penetrates through the inner snap ring and the fixing through hole on the heat conductive bracket such that the LED bulb radiator is fixed on the heat conductive bracket and the light distribution optical lens.

Only transparent silica gel for package is provided outside the LED chip on the optical engine module, an inner cover is provided outside the optical engine module with the transparent silica gel, and fluorescent powder coating is provided on an inner layer of the inner cover; or, no silica gel is packaged on the LED chip on the optical engine module, a concave inner cover filled with transparent insulating heat conductive liquid is provided outside the optical engine module, the LED chip on the optical engine module is soaked in the transparent insulating heat conductive liquid, fluorescent powder is provided in the transparent insulating heat conductive liquid, and the concave inner cover is an elastic inner cover of a thin concave structure.

In the foregoing snap ring lens type LED bulb, an electric connector is provided to the heat conductive bracket, the connector includes a connector plug, a contact pin is provided to the connector plug, and a contact pin welding spot on the tail end of the contact pin is welded to the optical engine module; the connector plug is provided to a fixed end for fixing after penetrating through a fixing hole of the connector plug on the universal LED bulb; the connector plug is cooperatively connected to a connector socket with a hole, and the connector socket is connected to a cable; the contact pin of the connector has a four-pin structure, wherein two pins are used for power supply access, and the other two pins are used for control access.

In the foregoing snap ring lens type LED bulb, the fixed end is a fusion ring or the fixed end is a fixing nut, a waterproof rubber ring slot is further provided to the connector plug, and a waterproof rubber ring is provided in the waterproof rubber ring slot; in order to prevent rotation, an antiskid groove is provided to the connector plug, and a corresponding projection is provided at the through hole of the heat conductive bracket; a three-hole flange is provided to the connector socket, and the connector socket is fixed to the radiator or a heat conductive converting plate on the lamp through the three-hole flange and a connector socket fixing screw, and a fixed adjusting rubber pad is further provided between the flange and the radiator or the heat conductive converting plate on the lamp to ensure the tightness of a waterproof surface; or the connector plug is provided with external threads which match with internal threads of the fixing nut on the connector socket provided with the waterproof rubber ring so as to be fixed to the connector plug; a slot is provided to the connector socket, and the waterproof rubber ring is provided in the slot.

On another aspect, the present invention further provides a variety of lamps using the foregoing LED bulb. The lamp of the present invention has a simple structure and a low manufacture cost, is quick, cheap and convenient to install, use and maintain and is unlikely to expand failure. Therefore, the present invention is possible to realize independent production and use of the bulb, lamp and the lighting control product of the LED bulb, greatly reduce the manufacturing links, achieve mass production and facilitate the application and the industrial scale of the LED energy-saving lighting products.

An LED street lamp using an installation interface bracket structure, includes an installation interface bracket punch-formed by sheet metal, wherein an installation interface is provided on the installation interface bracket, and an LED bulb provided with a radiator is provided on the installation interface; the installation interface bracket is installed on a lamp post; a lamp housing punch-formed by metal or die-casted by plastics is provided outside the installation interface bracket.

In the foregoing LED street lamp using the installation interface bracket structure, the installation interface bracket is an L-shaped bracket, and the installation interface bracket is fixed to the lamp post by an installation fixing bolt through a bracket installation flange with an L-shaped side face; a cable hole is provided to an installation interface of the installation interface bracket; the wire harness connector is provided to the installation interface bracket; the installation interface includes a surface in contact with the LED bulb and a hole connected to the LED bulb, on the installation interface bracket.

In the foregoing LED street lamp using the installation interface bracket structure, or the installation interface bracket may be a straight panel-shaped bracket, a bracket installation hole is provided at the center of the straight panel shape, and the installation interface bracket is installed on the lamp post through the bracket installation hole and a lamp post fixing ring; the cable hole is provided to an installation interface of the installation interface bracket; the street lamp using the installation interface bracket structure further includes a wire harness connector, the wire harness connector is used for connecting a plurality of LED bulbs to a power supply and a control circuit, and the wire harness connector is provided inside the lamp post connected to the installation interface bracket; the installation interface includes a surface in contact with the LED bulb and a hole connected to the LED bulb, on the installation interface bracket.

In the foregoing street lamp using the installation interface bracket structure, 6 flange fixing holes are provided to the installation interface and are uniformly distributed at a diameter D1, and the diameter D1 is a value obtained by subtracting a diameter of a fixing screw cap and then subtracting a margin of 0.8-4 mm from the outer diameter D of the LED bulb.

An LED street lamp using a lamp housing as an installation interface bracket structure includes the lamp housing punch-formed by sheet metal; the lamp housing includes a bracket panel folded to multiple pieces, an installation interface is provided to the bracket panel, and an LED bulb is provided to the installation interface; the lamp housing is fixed to a lamp post through a lamp post fixing element.

The foregoing LED street lamp using the lamp housing as the installation interface bracket structure further includes a wire harness connector, wherein the wire harness connector is provided to the lamp housing, and the wire harness connector is used for connecting a plurality of LED bulbs to a power supply and a control circuit.

In the foregoing LED street lamp using the lamp housing as the installation interface bracket structure, an edgefold for reinforcing the structural strength is provided at the edge of the lamp housing, and the installation interface includes a surface in contact with the LED bulb and a hole connected to the LED bulb, on the lamp housing; a lamp post fixing hole used for connecting the lamp post is formed in the upper part of the lamp post fixing bracket.

In the foregoing LED street lamp using the lamp housing as the installation interface bracket structure, the lamp post fixing element includes a lamp post fixing bracket, a lamp post fixing bracket bolt and a reinforcing plate, wherein the lamp post fixing bracket and the reinforcing plate are provided on the upper and lower sides of the lamp housing, and the lamp housing is fixed to the lamp post through the lamp post fixing bracket and the reinforcing plate; the lamp housing includes three bracket panels which are folded to form an angle, the lower part of the lamp post fixing bracket is a planar bracket, and the lamp post fixing bracket is fixed to the bracket panel at the center of the lamp housing from the upper side or the lower side of the lamp housing; or, the lamp housing includes two bracket panels which are folded to form an angle, the lamp post fixing bracket is fixed to the bracket panels provided to form the angle from the upper side or the lower side of the lamp housing, and a triangular bracket is provided at the lower part of the lamp post fixing bracket and is inverted V-shaped or V-shaped.

In the foregoing LED street lamp using the lamp housing as the installation interface bracket structure, 6 flange fixing holes and a radiator interface opening are provided to the installation interface, the flange fixing holes are used for fixing the LED bulb, and the radiator interface opening is used for enabling the LED bulb to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening is a value obtained by subtracting two times of a diameter of a fixing screw cap and then subtracting two times of the margin corresponding to the diameter D1 from the bulb outer diameter D.

An LED street lamp using an extrusion type radiator as a lamp main body structure, includes a metal extrusion type radiator formed by an extrusion process and a wire harness connector, wherein the extrusion type radiator is fixed to a lamp post; the extrusion type radiator includes a lamp post fixing sleeve, radiators are provided on both sides of the lamp post fixing sleeve, and an installation interface used for installing an LED bulb is provided to the radiator; the LED bulb is installed on the installation interface; the wire harness connector is provided to the lamp post fixing sleeve, and the wire harness connector is used for connecting a plurality of LED bulbs to a power supply and a control circuit.

In the foregoing LED street lamp using the extrusion type radiator as the lamp main body structure, the radiator includes a substrate, and fins are provided on one side of the substrate; the installation interface used for installing the LED bulb is provided on the other side of the substrate; a conducting wire bracket is provided on the other side of the substrate, and the conducting wire bracket is used for connecting a conducting wire led out from the LED bulb to the wire harness connector.

In the foregoing LED street lamp using the extrusion type radiator as the lamp main body structure, the installation interface includes a surface in contact with the LED bulb and a hole connected to the LED bulb on the radiator.

In the foregoing LED street lamp using the extrusion type radiator as the lamp main body structure, in the extrusion type radiator, the radiators on both sides are provided to form an angle; a lamp post seal head is provided at one end of the lamp post fixing sleeve, and the other end of the lamp post fixing sleeve is fixed to the lamp post through a lamp post fixing screw.

In the foregoing LED street lamp using the extrusion type radiator as the lamp main body structure, 6 flange fixing holes on the installation interface of the radiator are uniformly distributed at a diameter D1, and the diameter D1 is a value obtained by subtracting a diameter of a fixing screw cap and then subtracting a margin of 0.8-4 mm from the outer diameter D of the LED bulb.

In the lamp of the embodiment, the radiator and the bulb installation bracket are integrated to form an extrusion type radiator, and the LED bulb and all other auxiliary components thereof are collectively installed on the extrusion type radiator, so that the structure is simple, the manufacturing cost is low, and the installation, use and maintenance are convenient. When the lamp of the present invention is in operation, all fins of the radiator are vertical to the ground, thus the vertically dropped dust will not be accumulated on the fins; the radiator of the present invention has a large radiating area, meanwhile a plurality of LED bulbs are dispersed on the extrusion type radiator, each part of the extrusion type radiator is close to the heat source, so that the utilization of the radiating metal is very high, and nearly each gram of metal becomes the component of the extrusion type radiator. The use of entire metal is about 50% less than that of the radiator of the traditional LED street lamp, thus the consumption of the metal material is greatly reduced. The two radiators in the lamp of the present invention may form different unfolding angles, such that the lamp of the present invention is practical, aesthetic and individual.

An LED street lamp using an installation interface bracket combined member, includes the installation interface bracket combined member, wherein an LED bulb provided with a radiator is provided to an installation interface bracket combined member; a lamp housing punch-formed by metal or die-casted by plastics is provided outside the installation interface bracket combined member, and the installation interface bracket combined member is connected to a lamp post; the installation interface bracket combined member includes a pipe bracket which is formed by segmenting a standard pipe, a lamp fixing flange and a lamp housing and bulb fixing bracket, the pipe bracket, the lamp fixing flange and the lamp housing and bulb fixing bracket are connected, an installation interface used for installing the LED bulb is provided to the lamp housing and bulb fixing bracket, and the pipe bracket is connected to the lamp fixing flange and the lamp housing and bulb fixing bracket; the installation interface bracket combined member is connected to the lamp post through the lamp fixing flange.

In the foregoing LED street lamp using the installation interface bracket combined member, the installation interface includes a surface in contact with the LED bulb and a hole connected to the LED bulb on the lamp housing and bulb fixing bracket; the lamp housing and bulb fixing bracket is punch-formed by metal, the pipe bracket is connected to the center of the lamp housing and bulb fixing bracket, the lamp housing and bulb fixing bracket are engraved to be hollow around its portion connected to the pipe bracket, so that passage of a cable and formation of a chimney effect in the lamp housing are facilitated to ensure the ventilating and radiating effects; the lamp fixing flange is provided with a cable hole around its portion connected to the pipe bracket.

In the foregoing LED street lamp using the installation interface bracket combined member, a blind hole is provided to the lamp post, a flex is provided to the lamp post, and an LED bulb may be installed in the lamp post to emit light for decoration.

In the foregoing LED street lamp using the installation interface bracket combined member, 6 flange fixing holes are provided on the installation interface and are uniformly distributed at a diameter D1, and the diameter D1 is a value obtained by subtracting a diameter of a fixing screw cap and then subtracting a margin of 0.8-4 mm from the outer diameter D of the LED bulb.

An LED tunnel lamp using a lamp housing as an installation interface bracket structure, includes the lamp housing formed by a metal stamping or plastics die casting process, wherein the lamp housing includes an installation interface bracket plate used for installing a double-faced radiator and a foot screw hole used for fixedly installing the entire LED tunnel lamp; one or more rectangular opening used for installing the double-faced radiator is provided to the installation interface bracket plate, an installation interface is provided to the double-faced radiator, and an LED bulb is provided to the installation interface.

In the foregoing LED tunnel lamp using the double-faced radiator and the lamp housing bracket structure, a protection plate is further provided to the lamp housing.

In the foregoing LED tunnel lamp using the double-faced radiator and the lamp housing bracket structure, the double-faced radiator includes a substrate, and fins are provided on both sides of the substrate; the installation interface used for installing the LED bulb is provided on one side of the substrate, and circular or elliptic conical spaces are formed by cutting fins around the installation interface of the substrate according to the illumination angle of the light emitted by the bulb to the extent of not shading the light emitted by the LED bulb; the side on which the installation interface is provided of the double-faced radiator (103) penetrates through the rectangular opening; the installation interface includes a surface in contact with the LED bulb and a hole connected to the LED bulb on the double-faced radiator.

In the foregoing LED tunnel lamp using the double-faced radiator and the lamp housing bracket structure, 6 flange fixing holes on the installation interface are uniformly distributed at a diameter D1, and the diameter D1 is a value obtained by subtracting a diameter of a fixing screw cap and then subtracting a margin of 0.8-4 mm from the outer diameter D of the LED bulb.

A multi-light source LED ceiling lamp, includes a ceiling lamp fitting, wherein the ceiling lamp fitting includes a ceiling lamp base and a radiator, a base supporting pad is provided at the edge of the ceiling lamp base and is used to guarantee an enough ventilation distance between the ceiling lamp base and the ceiling; a plurality of openings used for installing radiators are provided to the ceiling lamp base, and a radiator is provided to each opening; an installation interface is provided at the lower part of each radiator for fixedly installing the LED bulb.

In the foregoing multi-light source LED ceiling lamp, the ceiling lamp fitting further includes a ceiling lampshade, a lampshade fixing clip is provided at the edge of the ceiling lampshade, and the lampshade fixing clip is used for installing the ceiling lampshade on the ceiling lamp base; the installation interface includes a surface in contact with the LED bulb and a hole connected to the LED bulb on the radiator.

In the foregoing multi-light source LED ceiling lamp, an vent hole A is provided at the edge of the opening of the ceiling lamp base, and in order to prevent insects from entering, the vent hole A is covered with a gauze; vent holes B are provided around the ceiling lampshade, and in order to prevent insects from entering, the vent holes B are covered with gauzes; external air may enter from the vent holes B and flow out from the vent hole A to achieve a convection radiating effect.

In the foregoing multi-light source LED ceiling lamp, the ceiling lamp fitting further includes an electric connector assembly; the electric connector assembly includes a connector socket, a connector socket fixing screw and an adjusting rubber pad; the connector socket is cooperatively connected to a connector plug on the LED bulb, a three-hole flange is provided to the connector socket, the connector socket is fixed to the radiator through the three-hole flange and the connector socket fixing screw, and a fixed adjusting rubber pad is further provided between the flange and the radiator to ensure the tightness of a waterproof surface.

In the foregoing multi-light source LED ceiling lamp, 6 flange fixing holes on the installation interface of the radiator are uniformly distributed at a diameter D1, and the diameter D1 is a value obtained by subtracting a diameter of a fixing screw cap and then subtracting a margin of 0.8-4 mm from the outer diameter D of the LED bulb.

An LED candle lamp, includes a candle lamp fitting, wherein the candle lamp fitting includes a heat conductive converting plate and a radiator; an installation interface is provided to the heat conductive converting plate to fixedly install an LED bulb; the heat conductive converting plate is connected to a candle lamp housing by adhesion, threaded connection or clamping manner, and the radiator is provided beneath the heat conductive converting plate.

In the foregoing LED candle lamp, the candle lamp fitting further includes a spool and an intermediate connecting element, wherein the spool is fixed to the intermediate connecting element through a spool fixing screw, and the intermediate connecting element is connected to the radiator through threads thereon, or through a lamp cap fixing screw or in a direct adhesion manner; the installation interface includes a surface in contact with the LED bulb and a hole connected to the LED bulb, on the heat conductive converting plate.

In the foregoing LED candle lamp, the radiator is a columnar radiator and is internally hollow, the radiator is provided with a radiator substrate inwards at the maximal outer diameter of the cylinder and is provided with fins towards the center of the cylinder in a radial manner, two or more layers of interrupted grooves are provided to the columnar radiator along a enclosed arc at a thickness of the substrate, and after the radiator is heated, external air flows into the center of the radiator through the interrupted grooves to form convection so as to achieve a cooling effect.

In the foregoing LED candle lamp, the candle lamp fitting further includes an electric connector assembly, the electric connector assembly includes a connector socket, a connector socket fixing screw and an adjusting rubber pad; the connector socket is cooperatively connected to a connector plug on the LED bulb, a three-hole flange is provided to the connector socket, the connector socket is fixed to the heat conductive converting plate through the three-hole flange and the connector socket fixing screw, and a fixed adjusting rubber pad is further provided between the flange and the heat conductive converting plate to ensure the tightness of a waterproof surface; when the LED bulb is installed, electrical connection of the LED bulb is achieved as long as the connector plug is in butt joint with a connector socket and the universal LED bulb is fixed; a conducting wire led out from the connector socket is guided to a power supply and a control circuit through the spool.

In the foregoing LED candle lamp, or the conducting wire led out from the connector socket is connected to a driving power supply, and the driving power supply is provided in the hollow part of the radiator.

In the foregoing LED candle lamp, an outer lampshade may also be provided outside the candle lamp fitting, and is fixed to the intermediate connecting element through a spring fixing clip.

In the foregoing LED candle lamp, 6 flange fixing holes on the installation interface of the heat conductive converting plate are uniformly distributed at a diameter D1 and the diameter D1 is a value obtained by subtracting a diameter of a fixing screw cap and then subtracting a margin of 0.8-4 mm from the outer diameter D of the LED bulb.

Compared with the prior art, in the present invention, the lens snap ring is used as the supporting component of the entire lamp, the inner snap rings in the lens snap ring are used as auxiliary support to finally form a structure in which LED bulb light source is constructed by inner snap rings as well as optical engine module and heat conductive bracket which are adhered to the inner snap rings, thus the structure is very stable. Moreover, the optical engine module in the present invention is enclosed in the sealed space defined by the inner snap rings, the heat conductive bracket and the lens, therefore the waterproof performance of the bulb is greatly improved without additionally providing other waterproof elements. The establishment of lamp by the snap ring lens type LED bulb of the present invention is implemented in a simple, easy, flexible and variable manner, such that the bulb, the lamp and the lighting control product of the LED bulb are independently produced and used, thereby greatly reducing the production procedures of LED lighting products, improving mass production and facilitating the industrialization of LED energy-saving lighting products. Moreover, in the present invention, one connector plug with a contact pin is fixed in the hole on the LED bulb in a trepanning manner, and wiring welding and mechanical fixing are performed in the bulb, thus the peripheral structure of the entire universal LED bulb is compact and smooth. The LED bulb has no external cable. When the bulb is installed, the connector plug is registered to the connector socket on the cable, and then the LED bulb is mechanically fixed. Meanwhile, a reliable electrical connection of the universal LED lamp is achieved. Moreover, in the present invention, the connector plug and the connector socket may be connected to directly achieve a reliable waterproof function without additional cost scarcely, thus the universal LED bulb equipped with the connector in the present invention may be both used outdoors and indoors and may also be used in explosion proof environments, such that the application range of the LED bulb is greatly expanded.

Figure 1:
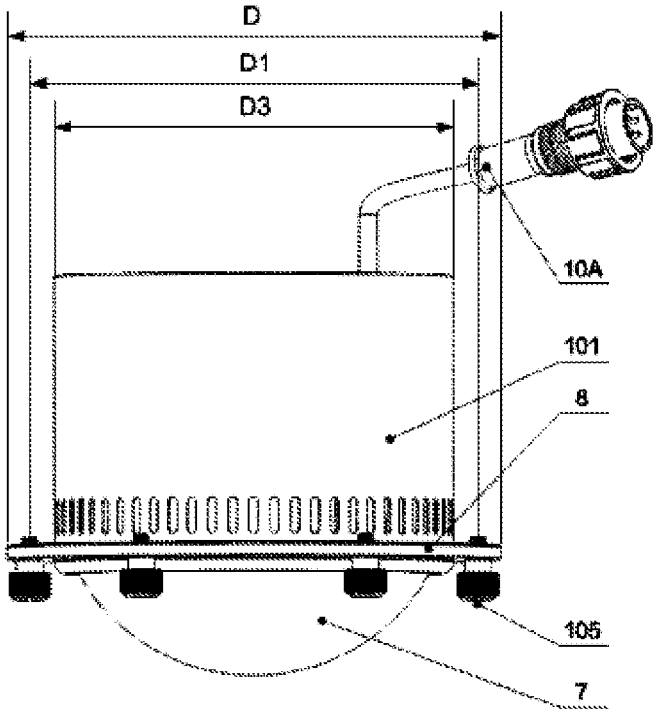
FIG. 1 is an external view of a bulb convex lens solution with a nonmetal radiator in the present invention.

Reference numerals: 1—heat conductive conversion bracket, 2—heat conductive pad, 3—heat conductive bracket, 4—optical engine module, 6—inner cover, 7—light distribution optical lens, 8—lens snap ring, 9—outer bulb cover, 10—connector socket, 10A—waterproof joint with a cable, 11—connector plug, 11A—cable fixing head, 12—radiator fixing screw, 14—fixing screw of the lens snap ring, 15—fixed end, 16—waterproof rubber ring, 17—contact pin, 18—slot of the waterproof rubber ring, 19—contact pin welding point, 22—connector plug fixing hole, 23—radiator fixing through hole, 24—fixed adjusting rubber pad, 25—connector socket fixing screw, 26—antiskid groove, 27—heat conductive converting plate, 28—fixing nut, 32—vacuum suction pipe, 33—upper stopper, 34—cooling fin, 35—lower stopper, 36—cable hole, 37—foam metal, 38—radiator fixing screw hole, 39—top-mounted fixing flange, 40—external power supply box, 42—screen mesh, 61—concave inner cover, 62—inner ring cover, 81—inner snap ring, 101—radiator outer cover, 102—LED bulb in the present invention, 103—radiator, 105—bulb fixing screw, and 301—bulb installation flange fixing hole.

DETAILED DESCRIPTION OF THE EMBODIMENTS

The present invention will be further illustrated below in conjunction with accompanying drawings and embodiments, which are not intended to limit the present invention thereto.

Embodiments

A method for constructing a universal LED bulb, comprising: supporting an optical engine core member of the LED bulb using a lens snap ring as the supporting main body of the bulb, using a light distribution optical lens as an auxiliary supporting structure of the bulb, and further using the light distribution optical lens as an installation base of the LED bulb optical engine core member, or using the light distribution optical lens as the installation base of an LED bulb radiator in cooperation with an inner snap ring, wherein an installation flange is provided on the lens snap ring for installing the bulb; the LED bulb optical engine core member is composed of a heat conductive bracket, an optical engine module, the inner snap ring and the light distribution optical lens, wherein an inner cover is provided outside the optical engine module, and an electric connector is provided on the heat conductive bracket; the optical engine module is make up of an optical engine die plate, an LED chip set and a relevant wiring by bonding and packaging, or a power supply drive chip is further integrated therein. The diameter of the lens snap ring is a bulb outer diameter D, the bulb outer diameter D and the upper limit of power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outside diameters D, in order to improve interchangeability and universality of the LED bulbs; on the relationship curve $W=1.1812e^{0.0361D}$, with 20 mm used as a lower limit of the bulb outer diameter D and 130 mm used as an upper limit, each 10 mm is set as a segment, the relationship curve is divided into 12 segments each of which is set to 10 mm to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D; the installation interface of the LED bulb includes a surface in contact with the LED bulb and a hole connected to the LED bulb, on the light fitting; a groove with a step is provided in the light distribution optical lens, and an integral structure in which the heat conductive bracket is combined with the optical engine module is adhered in the step, or the inner snap ring surrounds outside the optical engine module, an electric connector is fixed to the heat conductive bracket, the inner cover is provided outside the optical engine module, or an inner ring cover is further provided between the groove edge of the light distribution optical lens and the inner cover, so that the optical engine module is enclosed in a sealed waterproof space between the heat conductive bracket and the groove of the light distribution optical lens; or the inner snap ring cooperates with the light distribution optical lens to serve as the installation base of the LED bulb radiator, the upper end of the inner snap ring is adhered to the heat conductive bracket, a radiator fixing through hole is provided at the lower end of the inner snap ring, a pressure pad is provided in the fixing through hole to prevent water and for preventing a radiator fixing screw from crushing the heat conductive bracket; the thicknesses of the light distribution optical lens, the inner snap ring and the heat conductive bracket are adjusted to enable the heat conductive bracket to closely attached to the radiator when the lens snap ring is installed; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. A radiator is provided on the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by low temperature extrusion moulding and high temperature sintering of an ultrafine nonmetal heat conductive material (such as alumina, silicon carbide or the like), contact surfaces of the nonmetal radiator and the heat conductive conversion bracket are adhered into an integral piece by being coated a heat conductive adhesive, a rubber sheath or screw fixing glue is filled in the fixing screw hole of the nonmetal radiator for connecting a fixing screw, a radiator outer cover, which may be made from a metal material by stamping or from plastics by die casting to beautify the appearance of the bulb, is provided outside the nonmetal radiator, the heat conductive conversion bracket is overhead, the nonmetal radiator is formed into the shape of a screen mesh, and the nonmetal radiator is kept overhead by the heat conductive conversion bracket, so that the air is able to enter the screen mesh of the nonmetal radiator from the heat conductive conversion bracket; or the radiator is a metal radiator, the heat conductive pad is provided between the metal radiator and the heat conductive bracket, the metal radiator has a hollow structure, a foam metal is filled in the hollow part, superconductive liquid is filled in the hollow structure, upper and lower stoppers are pressed by interference fit or screwed by a threaded seal gum into the hollow structure to form a sealed space, and the sealed space is vacuumized; the fixing screw of the radiator penetrates through a fixing through hole on the inner snap ring, in order to be connected to the fixing screw hole of the nonmetal radiator or the metal radiator. Fluorescent powder is spray-coated on the LED chip, and transparent silica gel is covered thereon; or the number of the LED chips is configured according to the proportion of blue and red lights necessary for plants, and only the transparent silica gel is covered on the welded LED chip for package; or, the LED chip is merely packaged by the transparent silica gel, and then, an inner cover coated with fluorescent powder on the inner side is provided outside the packaged LED chip; or no silica gel is covered on the LED chip, a concave inner cover filled with transparent insulating heat conductive liquid is provided outside the LED chip, fluorescent powder is provided in the transparent insulating heat conductive liquid, and the concave inner cover is an elastic inner cover of a thin concave structure. A through hole is provided on the heat conductive bracket, a connector plug with a contact pin is inserted into the through hole and is fixed with the part inserted into the bulb as a fixed end, the tail end of the contact pin is welded with the optical engine die plate in the universal LED bulb, to form a simple electric interface on the outer surface of the universal LED bulb, during installation, electrical connection of the universal LED bulb is achieved as long as the connector plug is in butt-joint with a connector socket with a cable and the universal LED bulb is fixed; an eccentric position of the hole of the connector plug on the heat conductive bracket and a size of the fixed end of the connector plug are defined, such that the optical engine die plate in the LED bulb may meet the demands of arranging the LED chip and the power supply drive chip and registering them; the connector plug with the contact pin is of a four-pin structure, wherein two pins are used for power supply access, and the other two pins are used for control access; the fixed end is formed in a nut fixing manner or a fusion ring fixing manner; when the fixed end is formed in the nut fixing manner, a waterproof rubber ring is added between the connector plug and the heat conductive bracket to prevent water; in order to prevent rotation, an antiskid groove is provided to the connector plug, and a corresponding projection is provided at the through hole of the heat conductive bracket; a three-hole flange is provided on the connector socket and is fixed to a lamp radiator through a fixing screw, an adjusting rubber pad is provided between the connector socket and the radiator to adjust the thickness, in order to ensure tightness of a waterproof surface; or external threads are provided to the connector plug to match with the internal threads of the fixing nut on the connector socket provided with the waterproof rubber ring to prevent water; an slot is provided on the connector socket, and the waterproof rubber ring is provided in the slot to prevent water.

Figure 4:
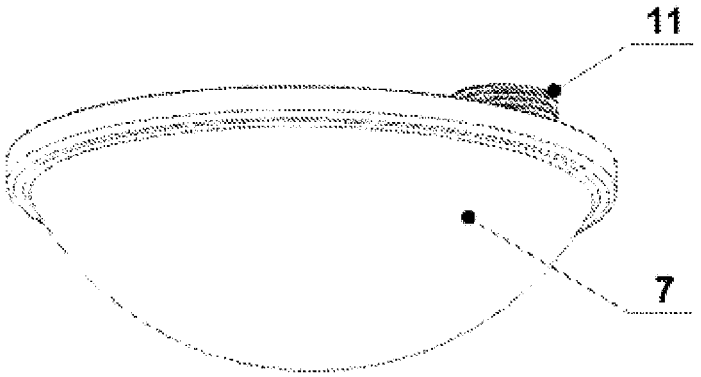
FIG. 4 is a schematic diagram of a structure of an optical engine core member of an LED bulb in the present invention.
Figure 5:
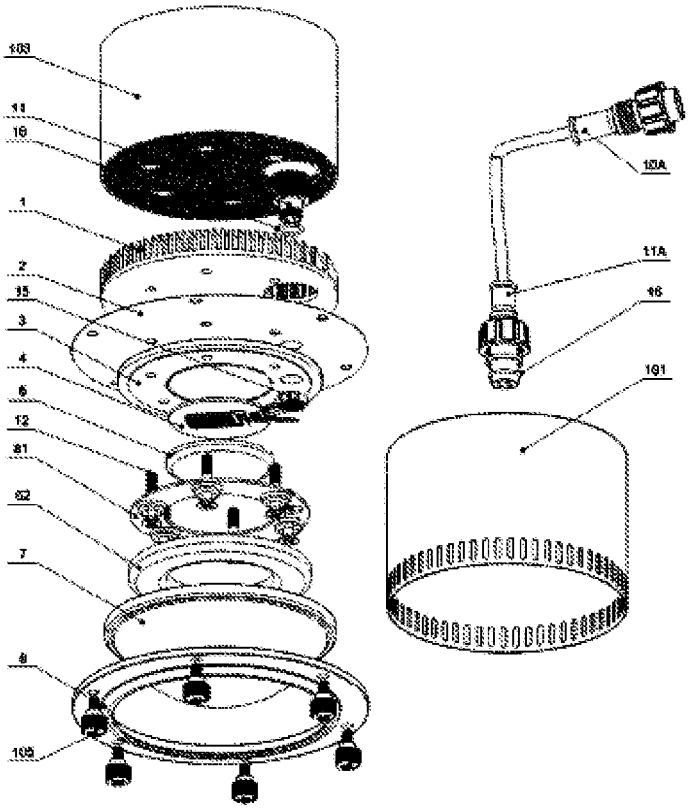
FIG. 5 is a structure diagram of a bulb in the present invention.
Figure 6:
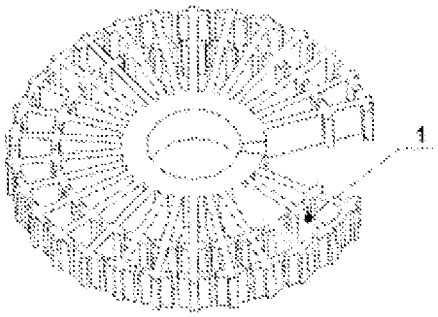
FIG. 6 is an external view of a heat conductive conversion bracket in an embodiment of the present invention.
Figure 7:
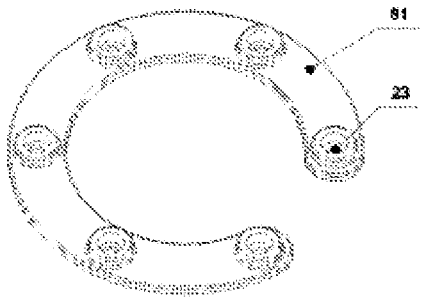
FIG. 7 is an external view of a C-shaped inner snap ring in an embodiment of the present invention.
Figure 8:
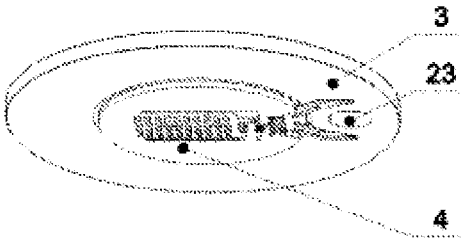
FIG. 8 is an external view of assembly of an optical engine module and a heat conductive bracket in an embodiment of the present invention.
Figure 12:
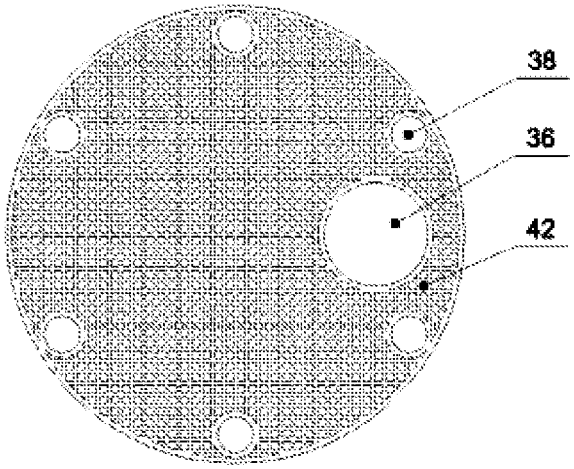
FIG. 12 is a sectional view of a nonmetal radiator in an embodiment of the present invention.
Figure 13:
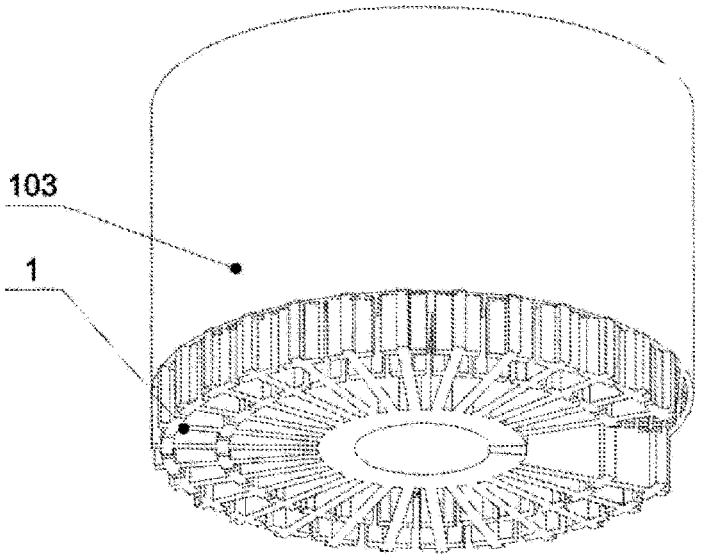
FIG. 13 is an external view of a nonmetal radiator assembly in an embodiment of the present invention.
Figure 14:
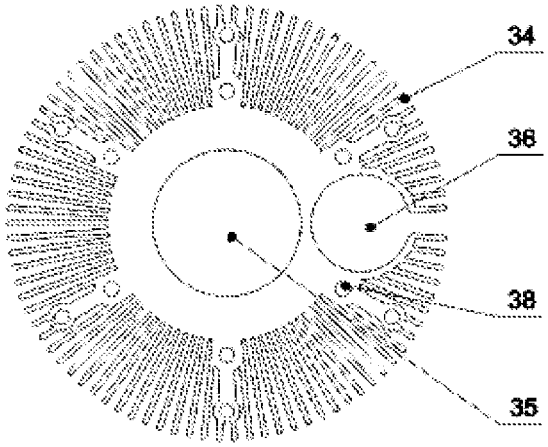
FIG. 14 is a sectional view of a metal radiator in an embodiment of the present invention.
Figure 15:
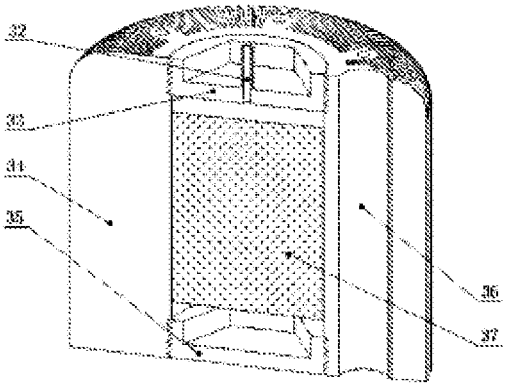
FIG. 15 is a schematic diagram of an internal structure of a metal radiator in an embodiment of the present invention.

A snap ring lens type LED bulb constructed according to the above-mentioned method, as shown in FIG. 4 and FIG. 5, includes a lens snap ring 8 with an installation flange, wherein at least a heat conductive bracket 3, an optical engine module 4 and a light distribution optical lens 7 are provided inside the lens snap ring 8 sequentially, a groove with a step is provided to the light distribution optical lens 7, the heat conductive bracket 3 is adhered in the step, the optical engine module 4 (as shown in FIG. 8) is adhered on the heat conductive bracket 3, a connector plug 11 is fixed to the heat conductive bracket 3, an inner cover 6 is provided outside the optical engine module 4, or an inner ring cover 62 is further provided between the groove edge of the light distribution optical lens 7 and the inner cover 6, and the optical engine module 4 is enclosed in a sealed waterproof space between the heat conductive bracket 3 and the light distribution optical lens 7. An inner snap ring 81 (a C-shaped inner snap ring as shown in FIG. 7) further surrounds the optical engine module 4, and when the lens snap ring 8 is installed, it can be ensured the upper surface of the heat conductive bracket 3 is closely attached to a radiator 103; an upper part of the inner snap ring 81 is adhered to the heat conductive bracket 3, and a the lower end thereof is provided with a radiator fixing through hole 23; a pressure pad is provided in the radiator fixing through hole 23 to prevent water and for preventing a radiator fixing screw from crushing the heat conductive bracket; a radiator fixing screw 12 penetrates through the inner snap ring 81 and the fixing through hole on the heat conductive bracket 3, such that the LED bulb radiator 103 is fixed on the heat conductive bracket 3 and the light distribution optical lens 7. Namely, if the LED bulb has small specification and does not need to be provided with the radiator, the inner snap ring 81 may be omitted. The optical engine module 4 is made up of an optical engine die plate, an LED chip set and a relevant wiring by bonding and packaging, or is further integrated with a power supply drive chip; or the heat conductive bracket 3 and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. The radiator 103 is provided to the heat conductive bracket 3, and a heat conductive pad 2 is provided between the radiator 103 and the heat conductive bracket 3; the radiator 103 is a nonmetal radiator assembly, the nonmetal radiator assembly includes a screen mesh-shaped nonmetal radiator (as shown in FIG. 13, a screen mesh 42 may be seen from the section, and any other structures capable of realizing ventilation may also be adopted, as shown in FIG. 6) and an overhead heat conductive conversion bracket 1 at the lower side thereof, a rubber sheath or screw fixing glue is filled in the radiator fixing screw hole 33 of the nonmetal radiator for connecting a fixing screw, a radiator outer cover 101 is provided outside the nonmetal radiator, and the section of the nonmetal radiator is as shown in FIG. 12. Or, the radiator 103 may also be a metal radiator, the heat conductive pad 2 is provided between the metal radiator and the heat conductive bracket 3, the metal radiator includes a cooling fin 34, as shown in FIG. 14 and FIG. 15, a superconductive fluid cavity is provided at the middle of the cooling fin 34, a foam metal 37 is filled in the superconductive fluid cavity and superconductive fluid is filled therein, an upper stopper 33 and a lower stopper 35 are provided on both ends of the superconductive fluid cavity, and a vacuum suction pipe 32 is provided on the upper stopper 33 or the lower stopper 35; a cable hole 36 used for penetration of a cable and a radiator fixing screw hole 38 are further provided to the radiator 103. A radiator fixing screw 12 internally penetrates through the inner snap ring 81 and the radiator fixing through hole 22 on the radiator 103 to fix the radiator 103 to the inner snap ring 81.

Figure 9:
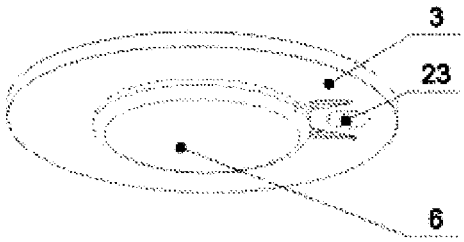
FIG. 9 is an external view of an optical engine module assembly provided with a flat inner cover in an embodiment of the present invention.
Figure 11:
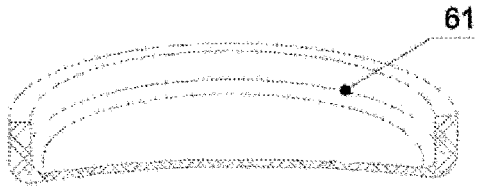
FIG. 11 is a cutaway view of a concave inner cover in an embodiment of the present invention.

As shown in FIG. 9, transparent silica gel for package is provided outside the LED chip on the optical engine module 4, the inner cover 6 is provided outside the optical engine module 4 with the transparent silica gel, and fluorescent powder coating is provided to the inner layer of the inner cover 6; or as shown in FIG. 11, no silica gel is packaged on the LED chip on the optical engine module 4, a concave inner cover 61 filled with transparent insulating heat conductive liquid is provided outside the optical engine module 4, the LED chip is soaked in the transparent insulating heat conductive liquid, fluorescent powder is provided in the transparent insulating heat conductive liquid, and the concave inner cover is an elastic inner cover of a thin concave structure, a cross-section diagram of which is as shown in FIG. 9. The optical engine module 4 is made up of the optical engine die plate, the LED chip set and the relevant wiring by bonding and packaging, or the power supply drive chip is further integrated on the optical engine die plate.

Figure 10:
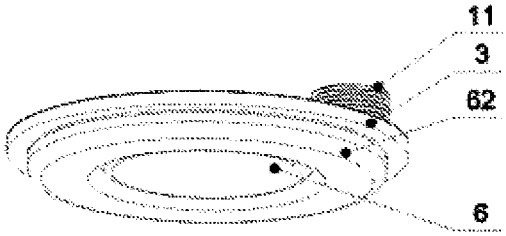
FIG. 10 is an external view of assembly of a heat conductive bracket and a connector with an inner snap ring and an optical engine module assembly in an embodiment of the present invention.
Figure 16:
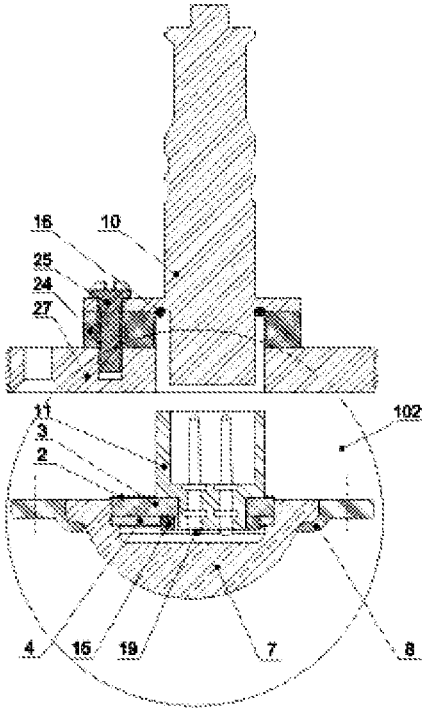
FIG. 16 is a schematic diagram of assembly of a structure of a small aperture bulb and a connector in an embodiment of the present invention.
Figure 17:
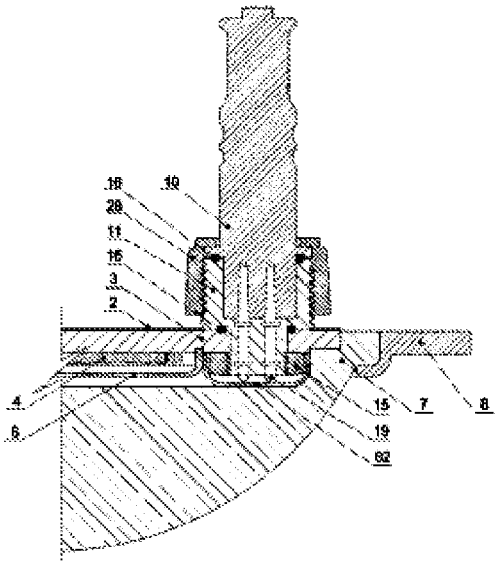
FIG. 17 is a schematic diagram of assembly of a structure of a large aperture bulb and a connector in an embodiment of the present invention.
Figure 18:
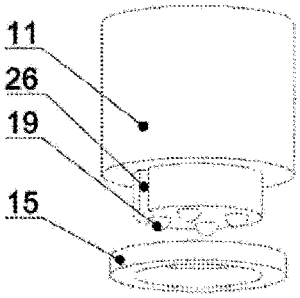
FIG. 18 is a schematic diagram of a structure of a connector plug at a fusion ring fixed end in the present invention.
Figure 19:
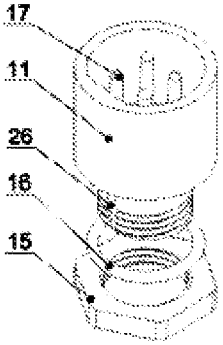
FIG. 19 is a first schematic diagram of a structure of a connector plug at a nut fixed end in the present invention.
Figure 20:
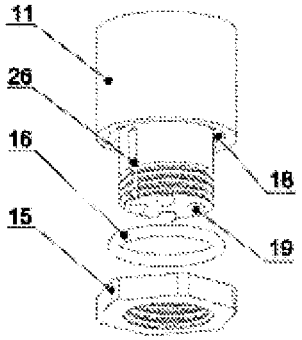
FIG. 20 is a second schematic diagram of a structure of a connector plug at a nut fixed end in the present invention.
Figure 21:
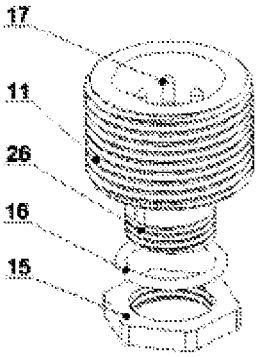
FIG. 21 is a schematic diagram of a structure of a connector plug with external threads in the present invention.
Figure 22:
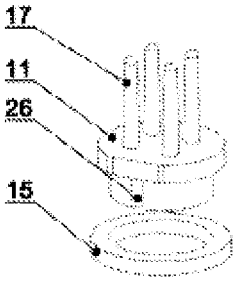
FIG. 22 is a schematic diagram of a structure of a pin type connector plug at a fusion ring fixed end in the present invention.
Figure 23:
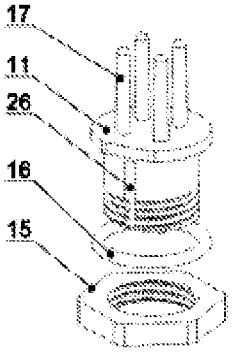
FIG. 23 is a schematic diagram of a structure of a pin type connector plug at a nut fixed end in the present invention.
Figure 24:
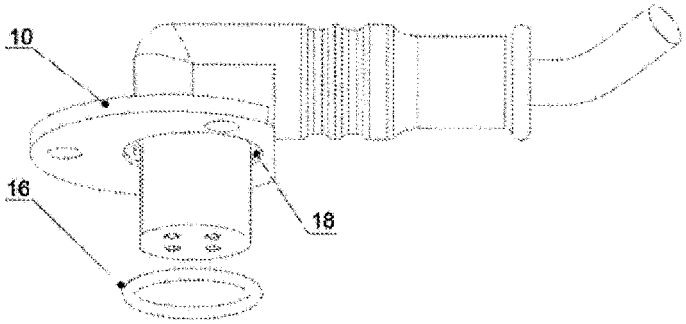
FIG. 24 is a schematic diagram of a structure of a connector socket fixedly connected in a bent shape in the present invention.
Figure 25:
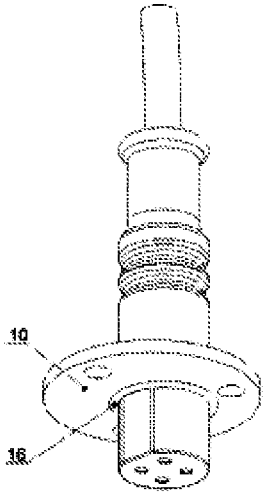
FIG. 25 is a schematic diagram of a structure of a connector socket fixedly connected in a straight shape in the present invention.
Figure 26:
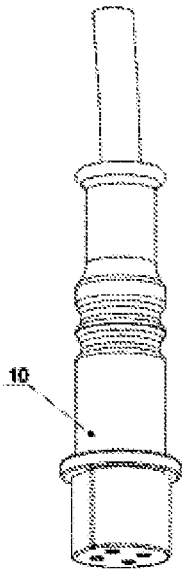
FIG. 26 is a schematic diagram of a structure of a straight-form connector socket non-fixedly connected in the present invention.

An electric connector is provided to the heat conductive bracket 3, the connector includes a connector plug 11, a contact pin 17 is provided on the connector plug 11, and a contact pin welding spot 19 on the tail end of the contact pin 17 is welded to the optical engine module 4; the connector plug 11 is fixed with a fixed end 15 after penetrating through a fixing hole 22 of the connector plug on the universal LED bulb; the connector plug 11 is cooperatively connected to a connector socket 10 with a hole, and the connector socket 10 is connected to a cable; the connector socket 10 is provided to a cable fixing head 11A provided on the other end of the cable in a waterproof joint 10A with the cable. The contact pin of the connector has a four-pin structure in which two pins are used for power supply access and the other two pins are used for control access. The fixed end 15 is a fusion ring, as shown in FIG. 18 and FIG. 22, wherein the connector plug 11 in FIG. 22 is provided with no protective jacket; or the fixed end 15 is a fixing nut, a waterproof rubber ring slot 18 is further provided to the connector plug 11, and a waterproof rubber ring 16 is provided in the waterproof rubber ring slot 18, as shown in FIG. 19, FIG. 20, FIG. 21 and FIG. 23, wherein the connector plug 11 in FIG. 23 has no protective jacket; in order to prevent rotation, an antiskid groove 26 is provided to the connector plug 11, and a corresponding projection is provided at the through hole of the heat conductive bracket 3; a three-hole flange (as shown in FIG. 24 and FIG. 25) is provided to the connector socket 10, the connector socket is fixed to the radiator 103 or a heat conductive converting plate 27 on the lamp through the three-hole flange and a connector socket fixing screw 25, and a fixed adjusting rubber pad 24 is further provided between the flange and the radiator 103 or the heat conductive converting plate 27 on the lamp to ensure tightness of a waterproof surface, as shown in FIG. 16; or the connector plug 11 is provided with external threads which match with internal threads of the fixing nut 28 on the connector socket 10 provided with the waterproof rubber ring 16 to be fixed to the connector plug 11, as shown in FIG. 17; a slot is provided to the connector socket 10, and the waterproof rubber ring 16 is provided in the slot, wherein the connector socket may also be a non-fixed connector socket as shown in FIG. 26. Meanwhile, in order to shield the fixed end of the electric connector, a power supply element and the like, and to keep the beautiful appearance of the bulb, a ring cover 62 is provided between the inner cover 6 and the inner snap ring 81, as shown in FIG. 10. A small aperture bulb (D≤70 mm) may be not provided with the ring cover 62 or the inner cover 6 generally (may also include the ring cover 62), and the schematic diagram of assembly of the structure thereof and the connector are as shown in FIG. 16; the schematic diagram of assembly of the structure of a large aperture bulb (D>70 mm) and the connector are as shown in FIG. 17.

The outer diameter D of the bulb and an upper limit of power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outside diameters D, in order to improve the interchangeability and universality of the LED bulbs. On the relationship curve $W=1.1812e^{0.0361D}$, with 20 mm used as a lower limit of D, 130 mm used as an upper limit, the relationship curve is divided into 12 segments each of which is set to 10 mm to form limited bulb outer diameter specifications, and the interchangeability and universality of the LED bulbs are further improved by the small amount of bulb outer diameter specifications. A screw hole distribution hole D1 for fixing the bulb and the diameter D2 of a radiator interface opening (an opening used for the radiator on the installation interface to penetrate through) of the lamp are influenced by a size of the used screw, and the diameter D1 is a value obtained by subtracting a diameter of a fixing screw cap and then subtracting a margin of 0.8-4 mm from the outer diameter D of the LED bulb; the diameter D2 of the radiator interface opening is a value obtained by subtracting two times of a diameter of a fixing screw cap and then subtracting two times of the margin corresponding to the diameter D1 from the bulb outer diameter D; the value of the wire outlet hole distance L (namely, the eccentric position of the connector plug on the heat conductive bracket) of the bulb is set according to the following table.

Figure 27:
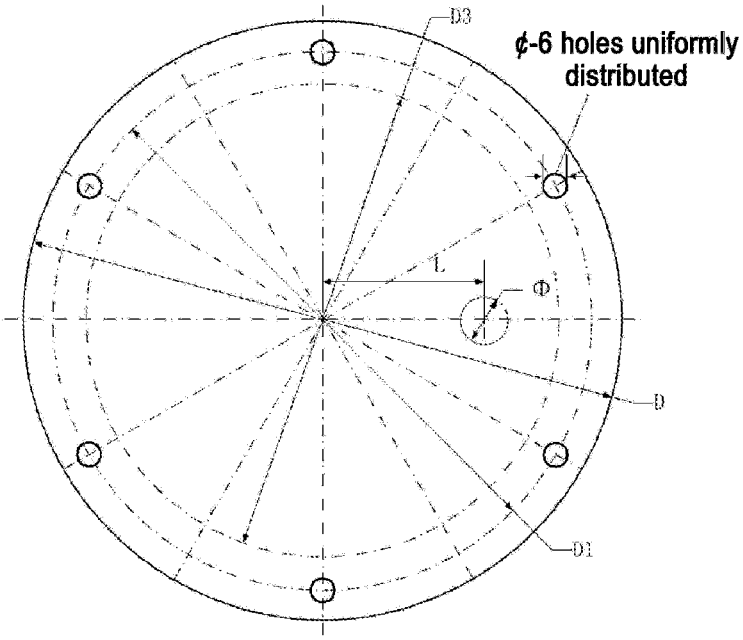
FIG. 27 is a diagram of a size and an opening of a bulb end installation interface in an embodiment of the present invention.
Figure 28:
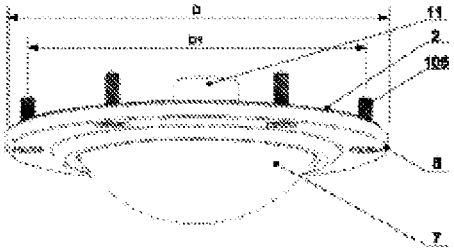
FIG. 28 is an external view of a small-specification bulb convex lens solution in the present invention.

In FIG. 1, FIG. 2, FIG. 3 and FIG. 28, the outer diameter D of the outline size of the bulb, the diameter D1 of the flange screw distribution circle and the outer diameter D3 of the radiator are manufactured according to regulated sizes, and the related sizes are set forth in FIG. 27 and the following table.

| Outer diameter D (mm) of bulb | Diameter D 1 (mm) of screw hole distribution circle | Diameter D 2 (mm) of radiator interface opening | Wire outlet hole distance L(mm) | Fixing screw specification ¢ (mm) | Suitable power (W) |
|---|---|---|---|---|---|
| 20 | 16 | 12 | 2 | M1.6 | <2.5 |
| 30 | 25 | 20 | 2 | M1.6 | <3.5 |
| 40 | 35 | 30 | 2 | M1.6 | <5 |
| 50 | 42 | 34 | 2 | M2.5 | <7 |
| 60 | 52 | 44 | 2 | M2.5 | <10 |
| 70 | 62 | 54 | 2 | M2.5 | <14.5 |
| 80 | 70 | 60 | 18 | M3.5 | <21 |
| 90 | 80 | 70 | 18 | M3.5 | <30 |
| 100 | 90 | 80 | 27 | M3.5 | <44 |
| 110 | 100 | 90 | 27 | M3.5 | <64 |
| 120 | 110 | 100 | 33 | M3.5 | <90 |
| 130 | 120 | 110 | 33 | M3.5 | <130 |

Note 1:
the outer diameter D3 of the bulb radiator or the outer cover is not larger than D2-1;
Note 2:
the diameter Φ of the bulb wire outlet hole is determined according to the size of the bulb connector (interface) plug.

Embodiment 1-1

An LED street lamp using an installation interface bracket structure, includes an installation interface bracket 103A punch-formed by sheet metal, wherein an installation interface is provided on the installation interface bracket 103A, and an LED bulb 102 provided with a radiator is provided on the installation interface; the installation interface bracket 103A is installed on a lamp post 108; a lamp housing 101 punch-formed by metal or die-casted by plastics is provided outside the installation interface bracket 103A. The installation interface bracket 103A is an L-shaped bracket, the installation interface bracket 103A is fixed to the lamp post 108 by an installation fixing bolt 109 through a bracket installation flange with an L-shaped side face; a cable hole is provided to the installation interface of the installation interface bracket 103A; the wire harness connector 106 is provided to the installation interface bracket 103A; the installation interface includes a surface in contact with the LED bulb 102 and a hole connected to the LED bulb on the installation interface bracket. Or, the installation interface bracket 103A is a straight panel-shaped bracket, a bracket installation hole is provided at the center of the straight panel shape, and the installation interface bracket 103A is installed on the lamp post 108 through the bracket installation hole and a lamp post fixing ring 116; the cable hole is provided to an installation interface of the installation interface bracket 103A; the LED street lamp using the installation interface bracket structure further includes a wire harness connector 106, the wire harness connector 106 is used for connecting a plurality of LED bulbs 102 to a power supply and a control circuit, and the wire harness connector 106 is provided inside the lamp post 108 connected to the installation interface bracket 103A; the installation interface includes a surface in contact with the LED bulb 102 and a hole connected to the LED bulb on the installation interface bracket 103A. 6 flange fixing holes are provided to the installation interface and are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, and the lamp housing 101 is assembled on the installation interface bracket 103A through a lamp housing fixing screw group 104.

Embodiment 1-2

Figure 29:
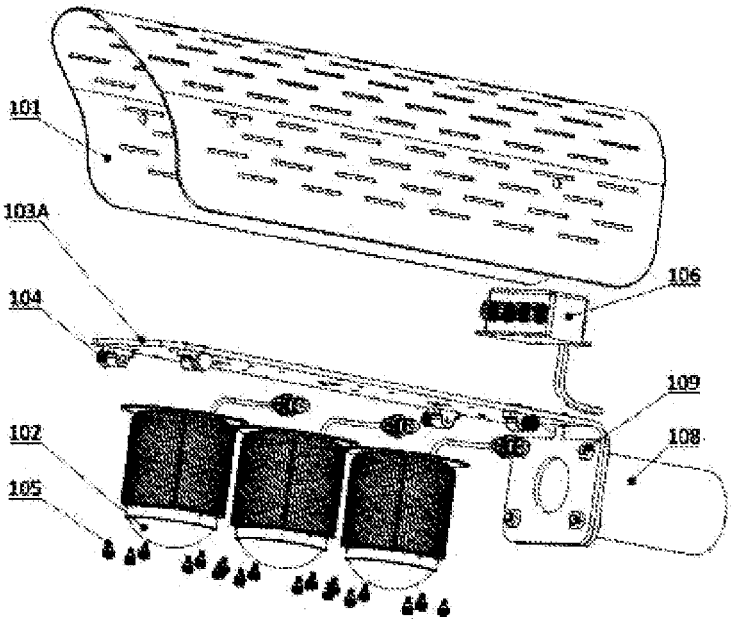
FIG. 29 is a schematic diagram of structures of embodiments 1-2 in the present invention.
Figure 30:
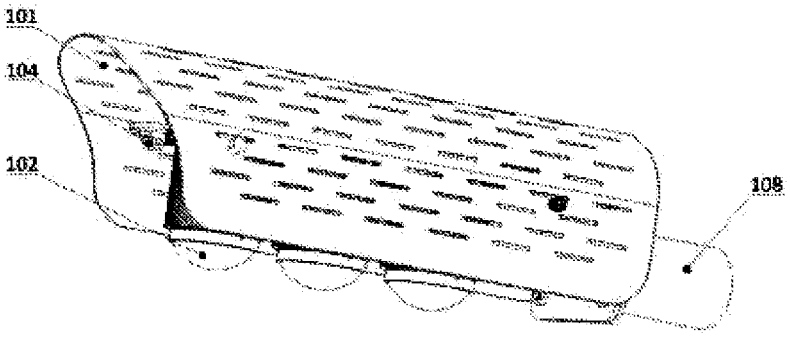
FIG. 30 a use state diagram of embodiment 1-2 of the present invention.

An LED street lamp using an installation interface bracket structure, as shown in FIG. 29 and FIG. 30, includes an installation interface bracket 103A punch-formed by sheet metal, wherein an installation interface is provided to the installation interface bracket 103A, and an LED bulb 102 provided with a radiator is provided on the installation interface; the installation interface bracket 103A is installed on a lamp post 108; a lamp housing 101 punch-formed by a metal or die-cast by plastics is provided outside the installation interface bracket 103A. The installation interface bracket 103A is an L-shaped bracket, the installation interface bracket 103A is fixed to the lamp post 108 by an installation fixing bolt 109 through a bracket installation flange with an L-shaped side face; a cable hole is provided on the installation interface of the installation interface bracket 103A; the LED street lamp using the installation interface bracket structure further includes a wire harness connector 106, the wire harness connector 106 is used for connecting a plurality of LED bulbs 102 to a power supply and a control circuit, the wire harness connector 106 is provided to the installation interface bracket 103A; the installation interface includes a surface in contact with the LED bulb 102 and a hole connected to the LED bulb, on the installation interface bracket. 6 flange fixing holes are provided on the installation interface and are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, the lamp housing 101 is assembled on the installation interface bracket 103A through a lamp housing fixing screw group 104, and the wire harness connector 106 is installed on the installation interface bracket 103A through a wire harness connector bracket and screw 107.

In the present invention, during maintenance, the bulb may be conveniently detached and installed only by detaching the lamp housing 101, so that the bulb is very convenient to overhaul and change.

Figure 34:
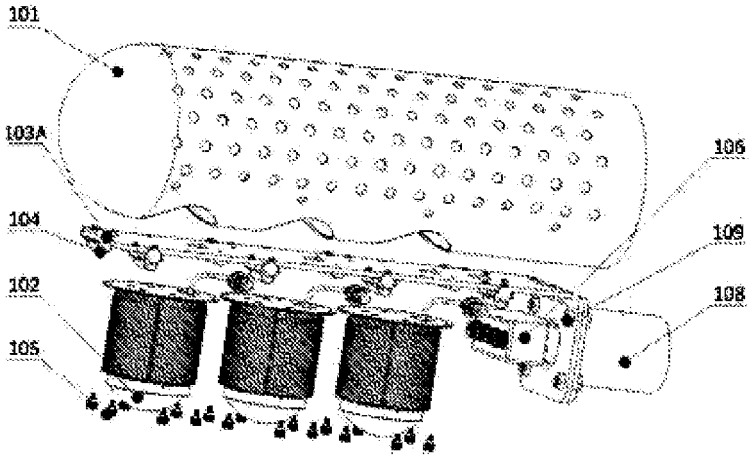
FIG. 34 is a schematic diagram of a structure when a cylindrical lamp housing is adopted in embodiment 1-2 of the present invention.
Figure 35:
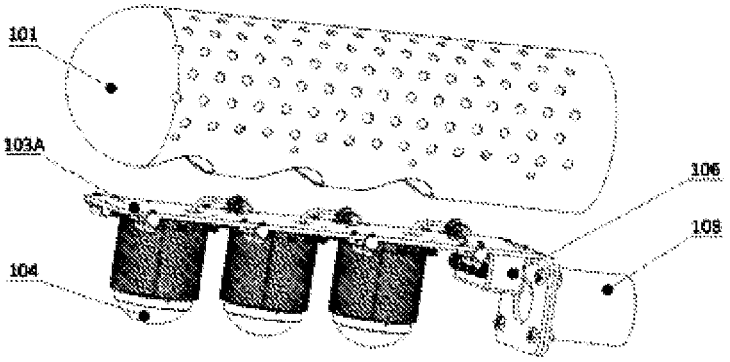
FIG. 35 is a maintenance state diagram when a cylindrical lamp housing is adopted in embodiment 1-2 of the present invention.

In the embodiment, the lamp housing 101 may also be a barrel-shaped lamp housing, as shown in FIG. 34 and FIG. 35.

Figure 31:
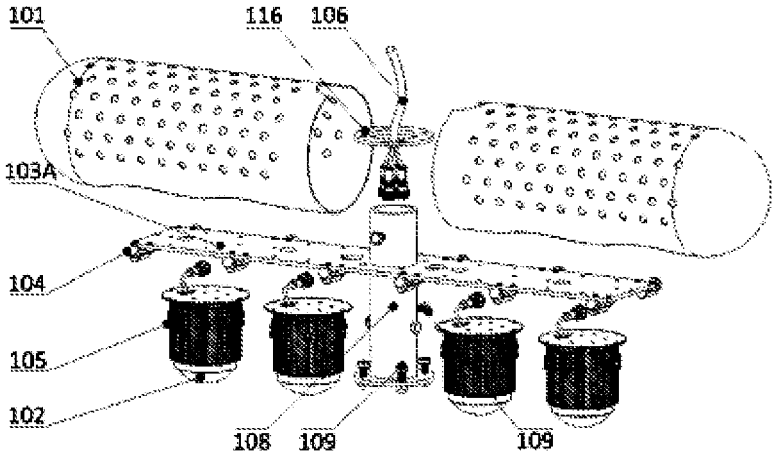
FIG. 31 is a schematic diagram of a structure when a lamp post fixing ring is adopted in embodiment 1-2 of the present invention.
Figure 32:
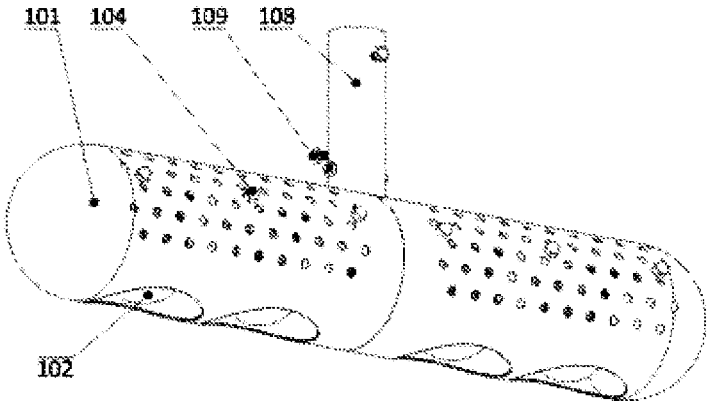
FIG. 32 is a use state diagram when a lamp post fixing ring is adopted in embodiment 1-2 of the present invention.
Figure 33:
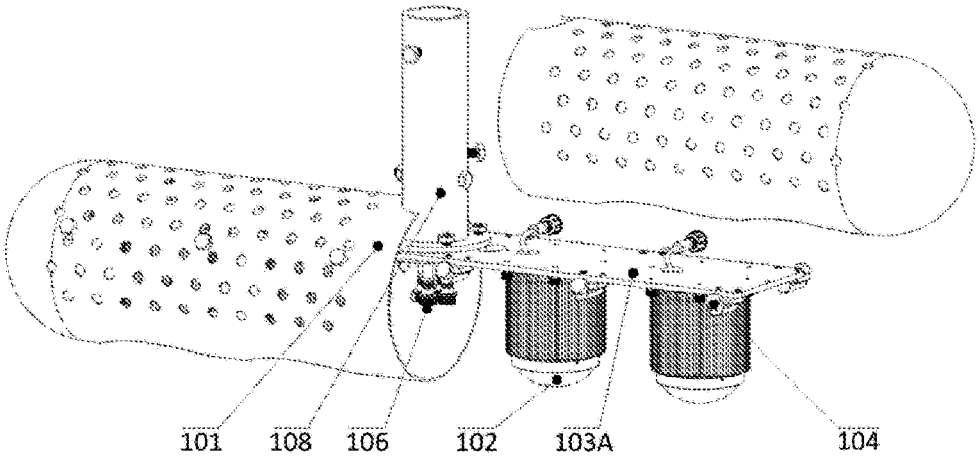
FIG. 33 is a maintenance state diagram when a lamp post fixing ring is adopted in embodiment 1-2 of the present invention.

In the embodiment, or the installation interface bracket 103A is a straight panel-shaped bracket, a bracket installation hole is provided at the center of the straight panel shape, the installation interface bracket 103A is installed on the lamp post 108 by the street lamp installation fixing bolt 109 through the lamp post fixing ring 116, the wire harness connector 106 is provided in the lamp post 108 connected to the installation interface bracket (103A), as shown in FIG. 31, FIG. 32 and FIG. 33. At this time, the wire harness connector and screw 107 does not need to be used.

The meanings of the reference numerals in the embodiment are as follows: 101—lamp housing, 102—LED bulb, 103A—installation interface bracket, 104—lamp housing fixing screw group, 105—bulb fixing screw, 106—wire harness connector, 107—wire harness connector bracket and screw, 108—lamp post, 109—street lamp installation fixing bolt, 116—lamp post fixing ring, 103—radiator, 301—bulb installation flange fixing hole, 302—bracket lining rivet hole, 501—bracket lining rivet projection, and 502—power supply or control end welding spot hole.

Embodiment 2

Figure 36:
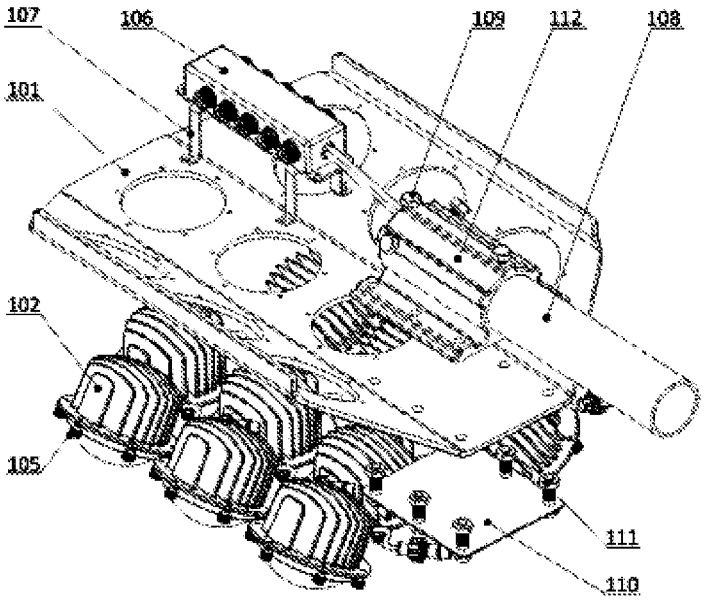
FIG. 36 is a schematic diagram of a structure of embodiment 2 in the present invention.
Figure 37:
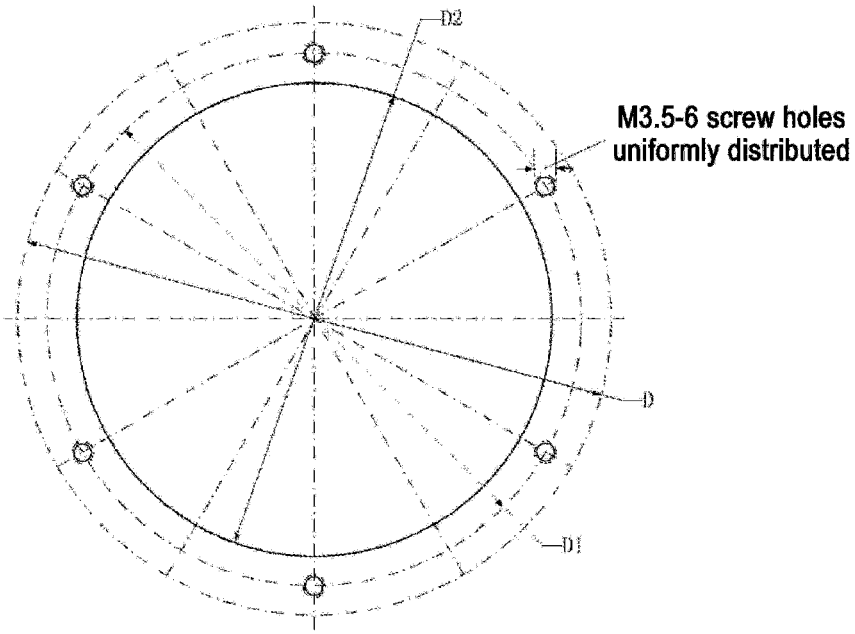
FIG. 37 is a schematic diagram of an installation interface of an installation interface bracket in embodiment 2 in the present invention.
Figure 38:
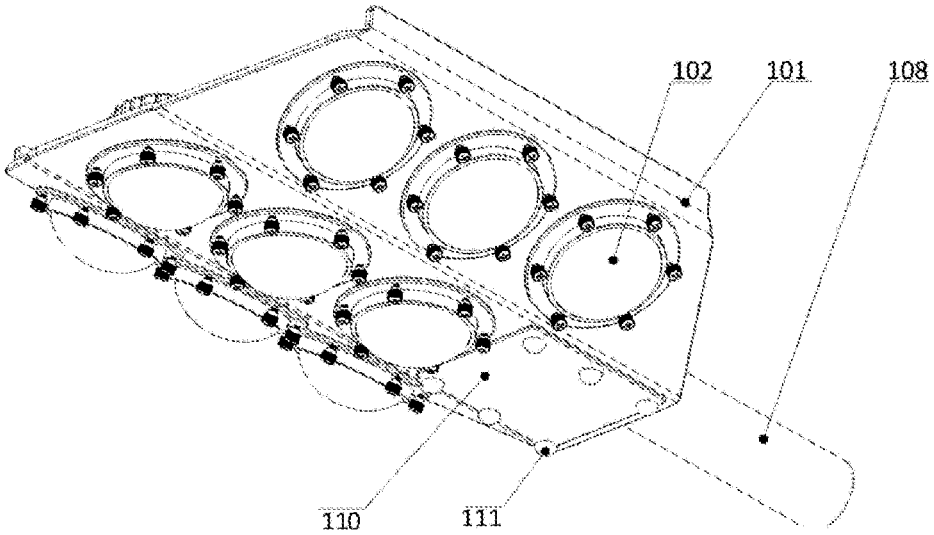
FIG. 38 is a vertical external view of embodiment 2 in the present invention.
Figure 39:
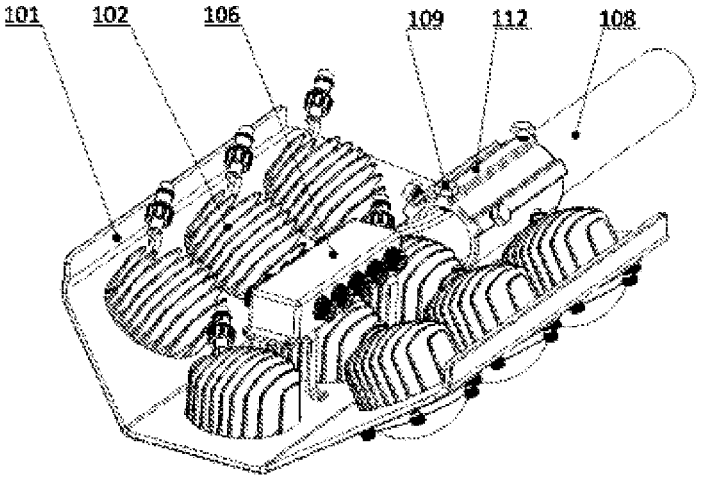
FIG. 39 is an overlooking external view of embodiment 2 in the present invention.

An LED street lamp using a lamp housing as an installation interface bracket structure, as shown in FIG. 36, FIG. 38 and FIG. 39, includes a lamp housing 101 punch-formed by sheet metal; the lamp housing 101 includes a bracket panel folded to multiple pieces, an installation interface is provided on the bracket panel, and an LED bulb 102 is provided on the installation interface; the lamp housing 101 is fixed to a lamp post 108 through a lamp post fixing element 108. The LED street lamp using the lamp housing as the installation interface bracket structure further includes a wire harness connector 106, wherein the wire harness connector 106 is provided to the lamp housing 101, and the wire harness connector is used for connecting a plurality of LED bulbs 102 to a power supply and a control circuit. An edgefold for reinforcing the structural strength is provided at the edge of the lamp housing 101, and the installation interface includes a surface in contact with the LED bulb 102 and a hole connected to the LED bulb on the lamp housing 101; a lamp post fixing hole used for connecting the lamp post 108 is formed in the upper part of the lamp post fixing bracket 112. The lamp post fixing element includes a lamp post fixing bracket 112, a lamp post fixing bracket bolt 111 and a reinforcing plate 110, wherein the lamp post fixing bracket 112 and the reinforcing plate 110 are provided on the upper and lower sides of the lamp housing 101, and the lamp housing 101 is fixed to the lamp post 108 through the lamp post fixing bracket 112 and the reinforcing plate 110; the lamp housing 101 includes three bracket panels which are folded to form an angle, the lower part of the lamp post fixing bracket 112 is a planar bracket, and the lamp post fixing bracket 112 is fixed to the bracket panel at the center of the lamp housing 101 from the upper side or the lower side of the lamp housing 101. 6 flange fixing holes and a radiator interface opening are provided on the installation interface, the flange fixing holes are used for fixing each LED bulb 102, and the radiator interface opening is used for enabling the LED bulb 102 to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening is a value obtained by subtracting two times of a diameter of a fixing screw cap and then subtracting two times of the margin corresponding to the diameter D1 from the bulb outer diameter D. The LED bulb 102 is installed on the installation interface through a bulb fixing screw 105, the wire harness connector 106 is installed on the lamp housing 101 through a wire harness connector bracket and screw 107, the lamp post fixing bracket 112 and the reinforcing plate 110 are fixed to the lamp housing 101 through the lamp post fixing bracket bolt 111, and the lamp post 108 is connected to the lamp post fixing bracket 112 through a lamp post fixing screw 109.

Figure 40:
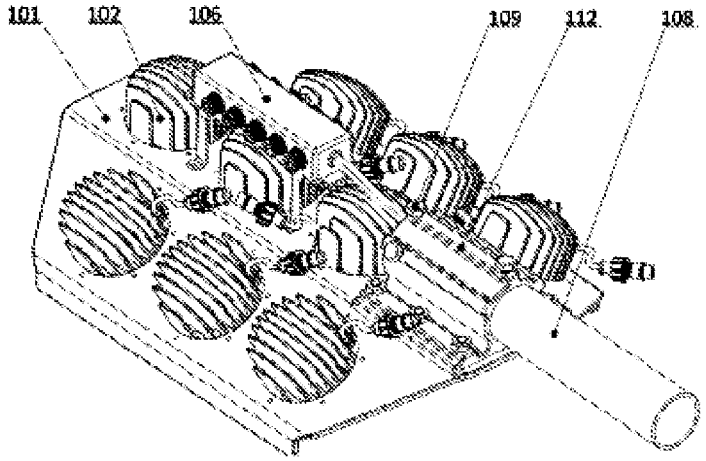
FIG. 40 is an overlooking external view when bracket panels at two sides are provided downwards to form an angle in embodiment 2 of the present invention.
Figure 44:
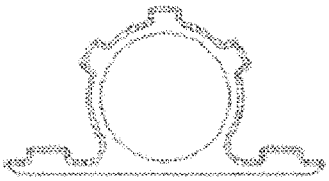
FIG. 44 is a projection drawing of a lamp post fixing bracket when bracket panels on two sides are provided downwards to form an angle in embodiment 2 of the present invention.

In the embodiment, the bracket panels at the two sides may also be provided to form a downward angle, as shown in FIG. 40 and FIG. 44.

Figure 41:
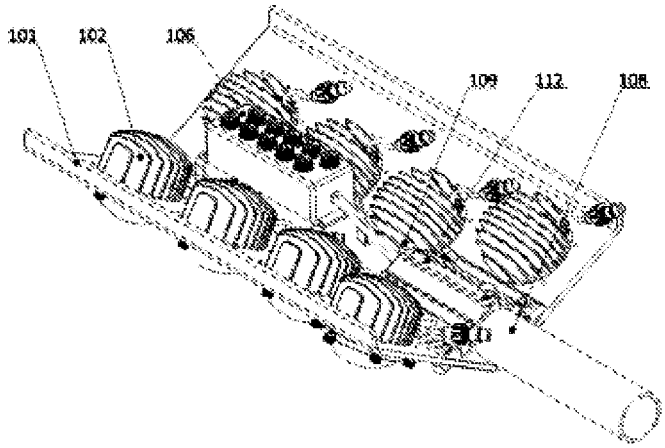
FIG. 41 is an overlooking external view when two bracket panels are adopted in embodiment 2 of the present invention.
Figure 45:
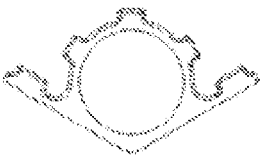
FIG. 45 is a projection drawing of a lamp post fixing bracket when two bracket panels are adopted in embodiment 2 of the present invention.

In the embodiment, or the lamp housing 101 includes two bracket panels which are folded to form an upward angle; at this time, a triangular bracket is provided at the lower part of the lamp post fixing bracket 112 and is V-shaped, as shown in FIG. 41 and FIG. 45.

Figure 42:
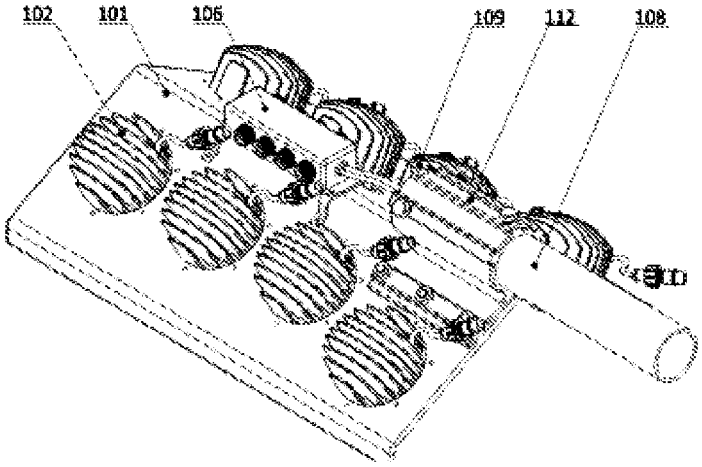
FIG. 42 is an overlooking external view when two bracket panels are provided downwards to form an angle in embodiment 2 of the present invention.
Figure 43:
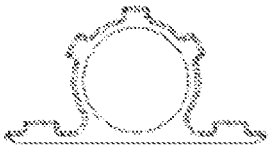
FIG. 43 is a projection drawing of a lamp post fixing bracket in embodiment 2 of the present invention.
Figure 46:
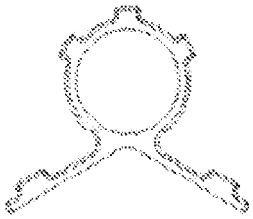
FIG. 46 is a projection drawing of a lamp post fixing bracket when two bracket panels are provided downwards to form an angle in embodiment 2 of the present invention.

In the embodiment, or the lamp housing 101 includes two bracket panels which are folded to form a downward angle; at this time, a triangular bracket is provided at the lower part of the lamp post fixing bracket 112 and is inverted V-shaped, as shown in FIG. 42 and FIG. 46.

In the present invention, in the case of an accidental event, the bulb may be conveniently maintained and changed only by directly detaching the bulb 102 from the lamp housing 101, as shown in FIG. 36.

The meanings of reference numerals in the embodiment are as follows: 101—lamp housing, 102—LED bulb, 105—bulb fixing screw, 106—wire harness connector, 107—wire harness connector bracket and screw, 108—lamp post, 109—lamp post fixing screw, 110—reinforcing plate, 111—lamp post fixing bracket bolt, and 112—lamp post fixing bracket.

Embodiment 3-1

An LED street lamp using an extrusion type radiator as a lamp main body structure, includes a metal extrusion type radiator 103 formed by an extrusion process and a wire harness connector 106, wherein the extrusion type radiator 103 is fixed to a lamp post 108; the extrusion type radiator 103 includes a lamp post fixing sleeve, radiators are provided on both sides of the lamp post fixing sleeve, and an installation interface used for installing an LED bulb 102 is provided to the radiator; the LED bulb 102 is installed on the installation interface; the wire harness connector 106 is provided to the lamp post fixing sleeve, and the wire harness connector 106 is used for connecting a plurality of LED bulbs 102 to a power supply and a control circuit. The radiator includes a substrate, and fins are provided on one side of the substrate; the installation interface used for installing the LED bulb 102 is provided on the other side of the substrate; a conducting wire bracket 112 is provided on the other side of the substrate, and the conducting wire bracket 112 is used for connecting a conducting wire led out from the LED bulb 102 to the wire harness connector 106. The installation interface includes a surface in contact with the LED bulb 102 and a hole connected to the LED bulb on the radiator. In the extrusion type radiator 103, the radiators on both sides are provided to form an angle; a lamp post seal head 101 is provided on one end of the lamp post fixing sleeve, and the other end of the lamp post fixing sleeve is fixed to the lamp post 108 through a lamp post fixing screw 109. 6 flange fixing holes on the installation interface of the radiator are uniformly distributed at a diameter D1, and the diameter D1 is a value obtained by subtracting a diameter of a fixing screw cap and then subtracting a margin of 0.8-4 mm from the outer diameter D of the LED bulb 102.

Embodiment 3-2

Figure 47:
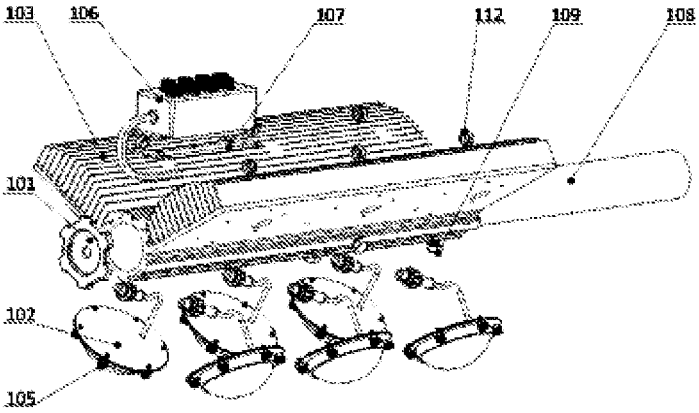
FIG. 47 is a schematic diagram of structures of embodiment 3-2 in the present invention.
Figure 48:
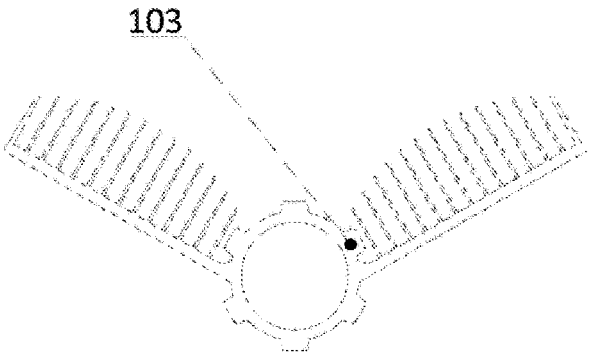
FIG. 48 is a projection drawing of an extrusion type radiator in embodiment 3 of the present invention.
Figure 51:
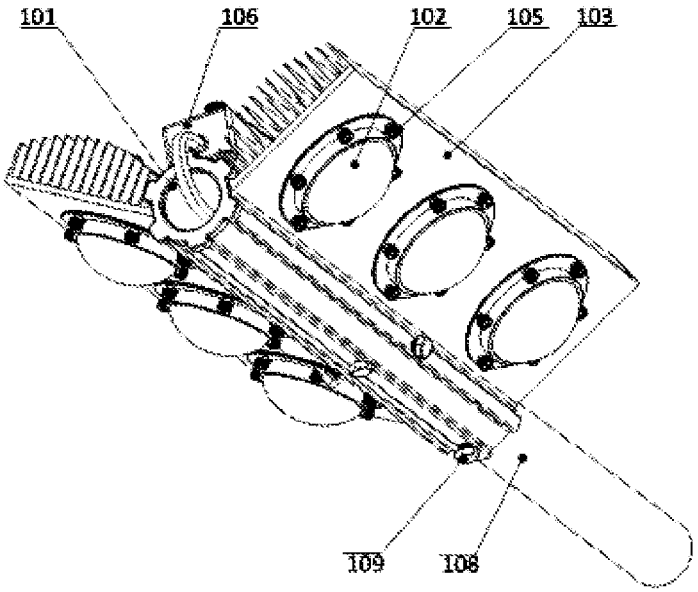
FIG. 51 is a vertical external view in the embodiment 3-2 of the present invention.

An LED street lamp using an extrusion type radiator as a lamp main body structure, as shown in FIG. 47, FIG. 48 and FIG. 51, includes a metal extrusion type radiator 103 formed by an extrusion process and a wire harness connector 106, wherein the extrusion type radiator 103 is fixed to a lamp post 108; the extrusion type radiator 103 includes a lamp post fixing sleeve, radiators are provided on both sides of the lamp post fixing sleeve, and an installation interface used for installing an LED bulb 102 is provided to the radiator; the LED bulb 102 is installed on the installation interface; the wire harness connector 106 is provided to the lamp post fixing sleeve, and the wire harness connector 106 is used for connecting a plurality of LED bulbs 102 to a power supply and a control circuit. The radiator includes a substrate, and fins are provided on one side of the substrate; the installation interface used for installing the LED bulb 102 is provided on the other side of the substrate; a conducting wire bracket 112 is provided on the other side of the substrate, and the conducting wire bracket 112 is used for connecting a conducting wire led out from the LED bulb 102 to the wire harness connector 106. The installation interface includes a surface in contact with the LED bulb 102 and a hole connected to the LED bulb on the radiator. In the extrusion type radiator 103, the radiators on both sides are provided upwards to form an angle; a lamp post seal head 101 is provided at one end of the lamp post fixing sleeve, and the other end of the lamp post fixing sleeve is fixed to the lamp post 108 through a lamp post fixing screw 109. 6 flange fixing holes on the installation interface of the radiator are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, and the wire harness connector 106 is installed on the lamp post fixing sleeve through a wire harness connector bracket and fixing screw 107.

Figure 49:
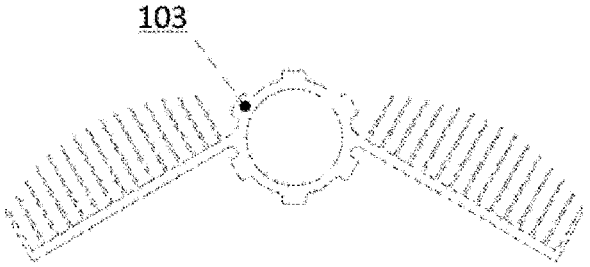
FIG. 49 is another projection drawing of an extrusion type radiator in embodiment 3 of the present invention.
Figure 50:
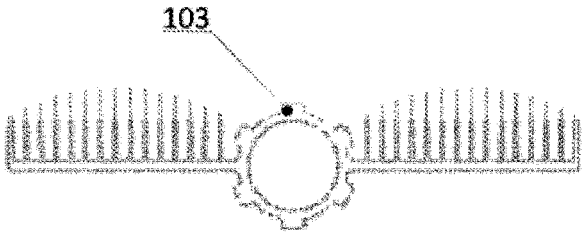
FIG. 50 is yet another projection drawing of an extrusion type radiator in embodiment 3 of the present invention.
Figure 52:
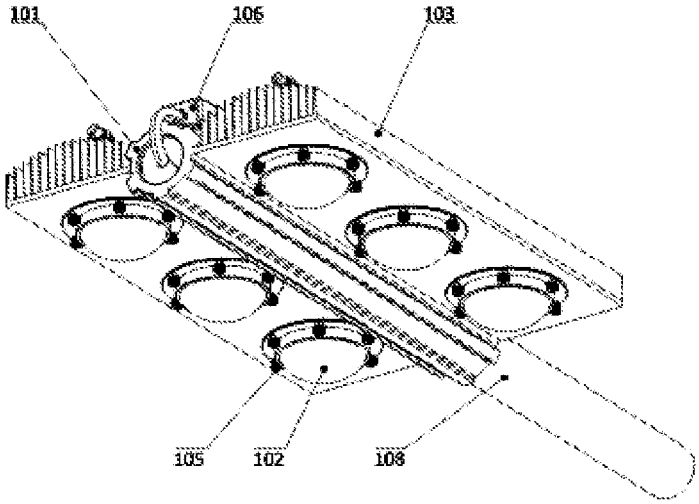
FIG. 52 is a vertical external view when a radiator is horizontally provided in embodiment 3-2 of the present invention.
Figure 53:
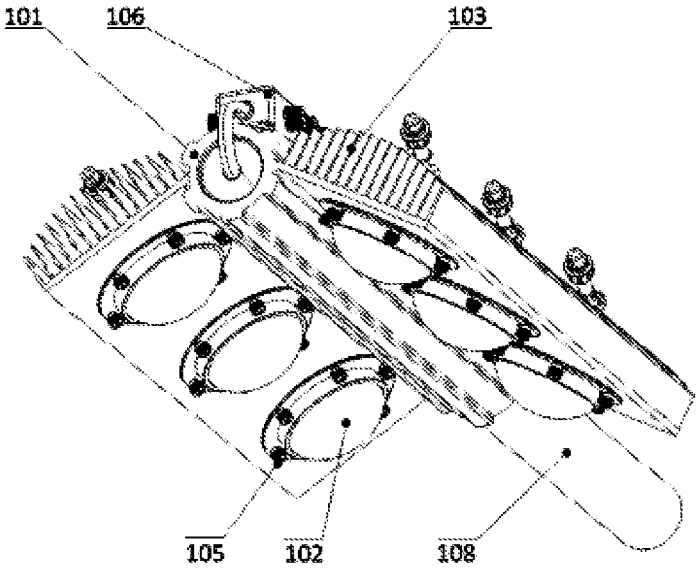
FIG. 53 is a vertical schematic diagram when radiators are provided downwards to form an angle in the embodiment 3-2 of the present invention.
Figure 54:
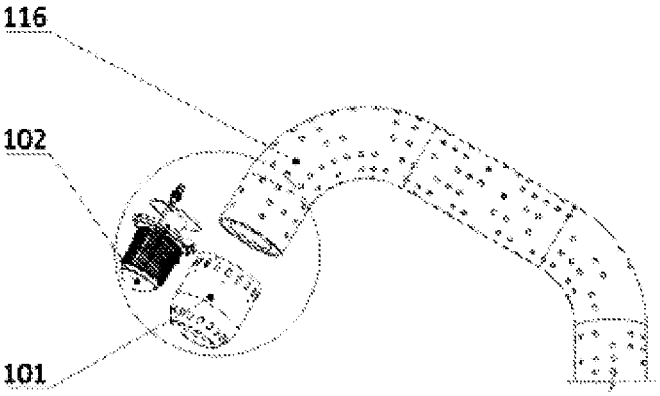
FIG. 54 is a schematic diagram of a structure of embodiment 4 of the present invention.
Figure 55:
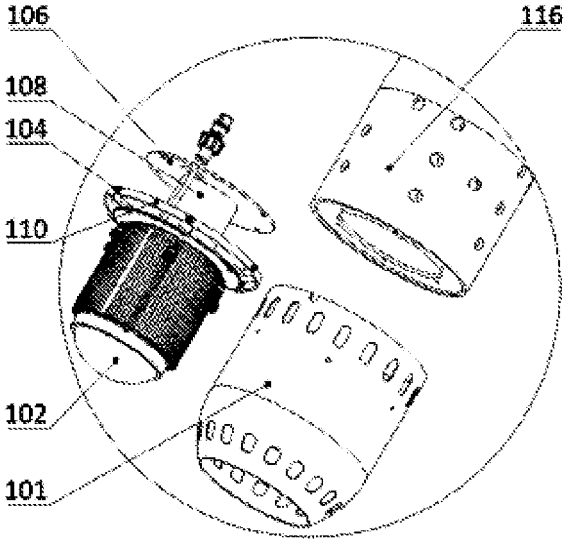
FIG. 55 is a structure diagram of a lamp cap in embodiment 4 of the present invention.
Figure 56:
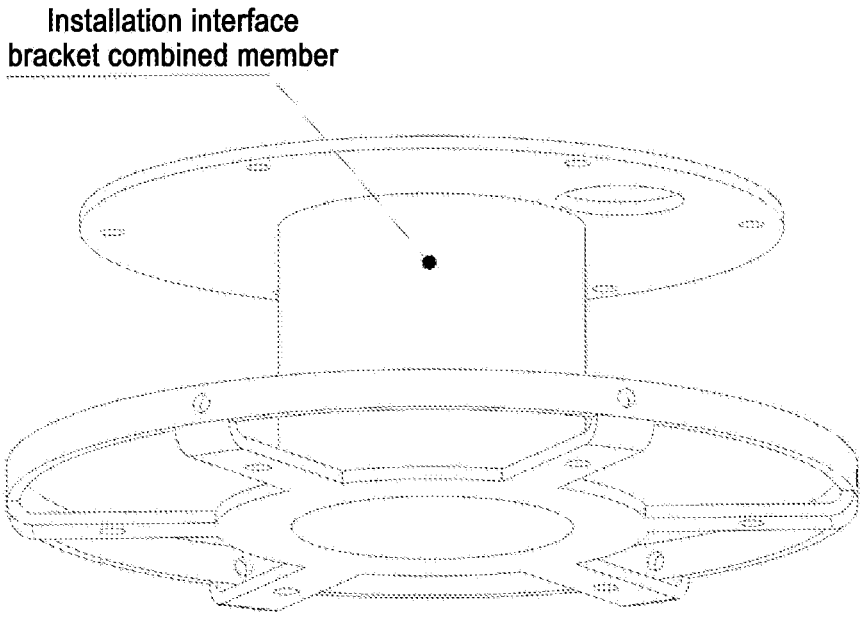
FIG. 56 is a schematic diagram of a structure of an installation interface bracket combined member in embodiment 4 of the present invention.
Figure 57:
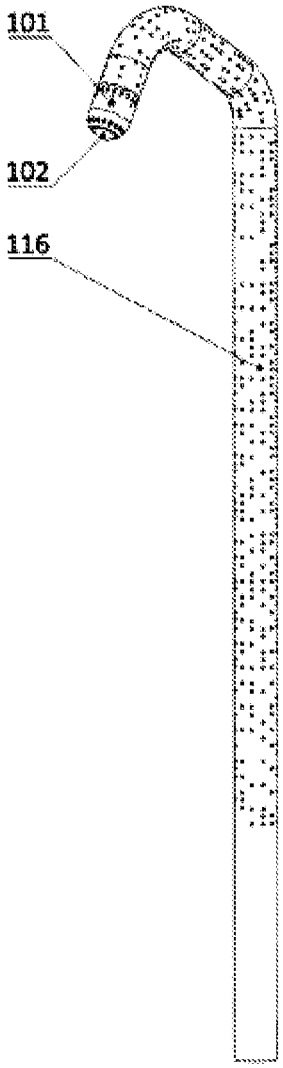
FIG. 57 is an external view of embodiment 4 of the present invention.
Figure 58:
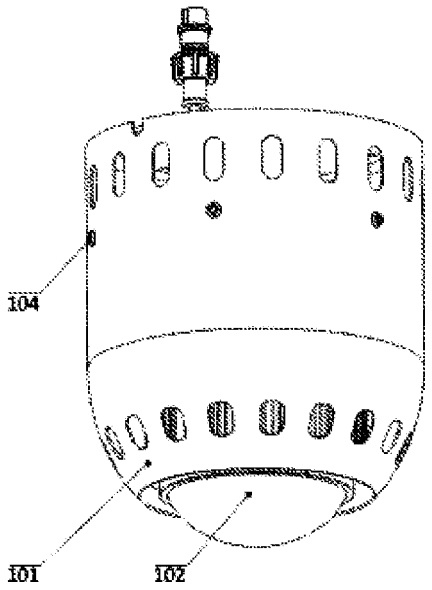
FIG. 58 is an external view of a lamp cap in the embodiment 4 of the present invention.

In the present invention, as shown in FIG. 50 and FIG. 52, the radiators of the extrusion type radiator 103 may also be provided horizontally. In the present invention, as shown in FIG. 49 and FIG. 53, the radiators of the extrusion type radiator 103 may also be provided downwards to form an angle. Therefore, the present invention has better practicability.

When an accidental event of the street lamp occurs, the bulb 102 is only directly detached from the extrusion type radiator 103, as shown in FIG. 52.

In the lamp of the embodiment, the radiator and the bulb installation bracket are integrated to form an extrusion type radiator, and the LED bulb and all other auxiliary components are overall integrally installed on the extrusion type radiator, so that the structure is simple, the manufacturing cost is low, and the installation, use and maintenance are convenient. When the lamp of the present invention is in operation, all fins of the radiator are vertical to the ground, thus the vertically dropping dust will not be accumulated on the fins; the radiator in the present invention has a large radiating area, meanwhile a plurality of LED bulbs are dispersed on the extrusion type radiator, each part of the extrusion type radiator is close to the heat source, so the utilization of the radiating metal is very high, nearly each gram of metal becomes the component of the extrusion type radiator, the entire metal dosage is about 50% less than that of the radiator of the traditional LED street lamp, thus the consumption of the metal material is greatly reduced. The two radiators in the lamp of the present invention may form different unfolding angles, such that the lamp of the present invention is practical, beautiful and individual.

The meanings of the reference numerals in the embodiment are as follows: 101—lamp post seal head, 102—LED bulb, 103—extrusion type radiator, 105—bulb fixing screw, 106—wire harness connector, 107—wire harness connector bracket and fixing screw, 108—lamp post, 109—lamp post fixing screw, 112—conducting wire bracket, 301—bulb installation flange fixing hole, 302—bracket lining rivet hole, 501—bracket lining rivet projection, and 502—power supply or control end welding spot hole.

Embodiment 4

An LED street lamp using an installation interface bracket combined member, as shown in FIG. 1, FIG. 2, FIG. 24, FIG. 25 and FIG. 26, includes the installation interface bracket combined member, wherein an LED bulb 102 with waterproof and dustproof functions and provided with a radiator is provided to the installation interface bracket combined member; a lamp housing 101 punch-formed by metal or die-casted by plastics is provided outside the installation interface bracket combined member, and the installation interface bracket combined member is connected to a lamp post 116; the installation interface bracket combined member includes a pipe bracket 108 which is formed by segmenting a standard pipe, a lamp fixing flange 106 and a lamp housing and bulb fixing bracket 110, the pipe bracket 108, the lamp fixing flange 106 and the lamp housing and bulb fixing bracket 110 are connected, an installation interface used for installing the LED bulb 102 is provided to the lamp housing and bulb fixing bracket 110, and the pipe bracket 108 is connected to the lamp fixing flange 106 and the lamp housing and bulb fixing bracket 110; the installation interface bracket combined member is connected to the lamp post 116 through the lamp fixing flange 106. The installation interface includes a surface in contact with the LED bulb 102 and a hole connected to the LED bulb, on the lamp housing and bulb fixing bracket 110; the lamp housing and bulb fixing bracket 110 is punch-formed by metal, the pipe bracket (108) is connected to the center of the lamp housing and bulb fixing bracket 110, the lamp housing and bulb fixing bracket 110 are engraved to be hollow around its portion connected to the pipe bracket (108), so that passage of a cable and formation of a chimney effect in the lamp housing are facilitated to ensure the ventilating and radiating effects; the lamp fixing flange 106 is provided with a cable hole around its portion connected to the pipe bracket 108. A blind hole is provided to the lamp post 116, a flex is provided to the lamp post 116, and an LED bulb may be installed in the lamp post 116 to emit light for decoration, which is suitable for such environments with complicated installation conditions as parks, gardens and the like. The lamp housing 101 is installed on the lamp housing and bulb fixing bracket 110 through a lamp housing fixing screw 104, and the LED bulb 102 is installed on the lamp housing and bulb fixing bracket 110 through a bulb fixing screw 105.

Figure 2:
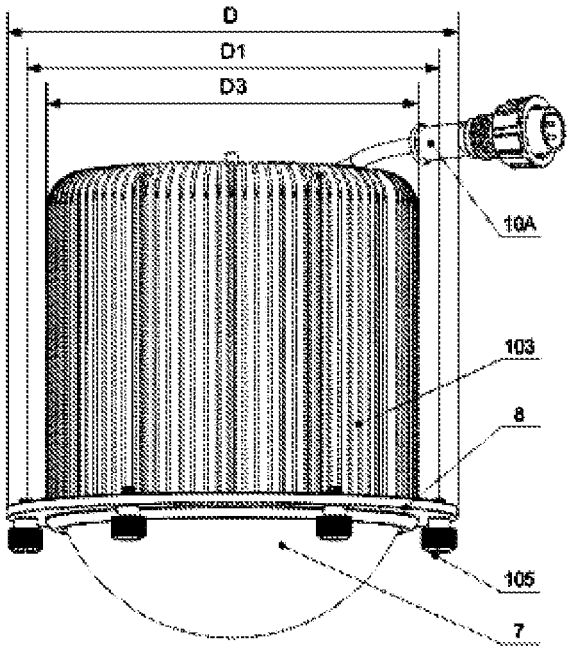
FIG. 2 is an external view of a bulb convex lens solution with a metal radiator in the present invention.
Figure 3:
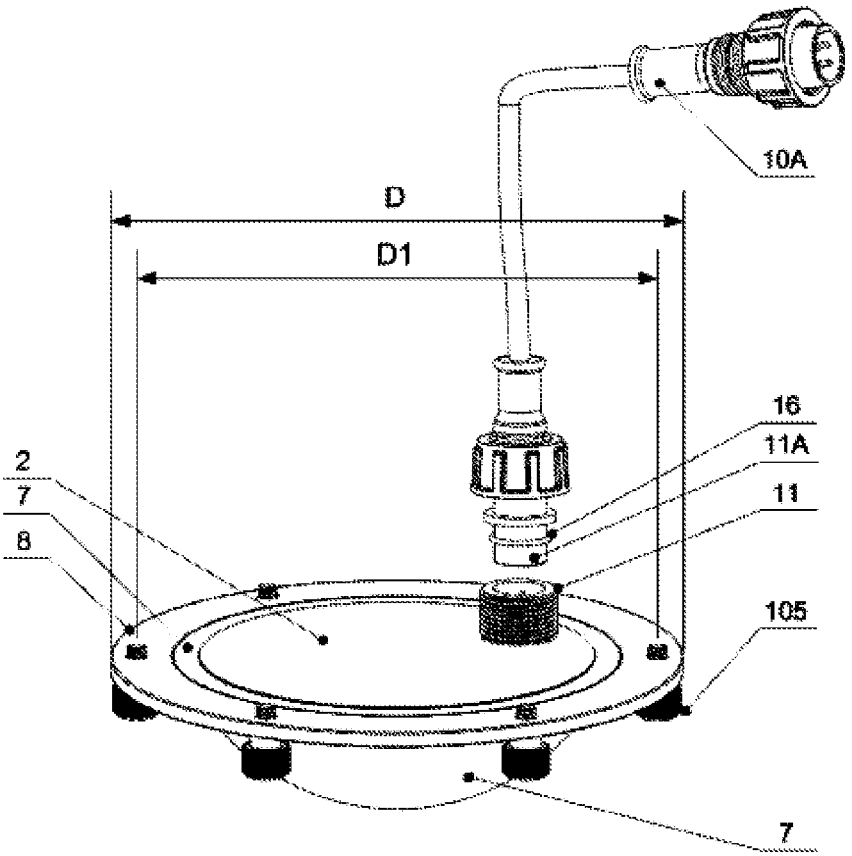
FIG. 3 is an external view of a waterproof connector solution of an LED bulb convex lens in the present invention.

In the case of an accidental event of the present invention, the bulb may be conveniently detached and installed only by detaching the lamp housing 101, as shown in FIG. 1 and FIG. 2, so that the bulb is very convenient to overhaul and change.

The lamp in the embodiment adopts the installation interface bracket combined member as the installation fixing component, the installation interface bracket combined member provides a supporting interface for the LED bulb, and the lamp housing, the LED bulb and other auxiliary components are overall collectively installed on the bracket combined member, thereby having simple structure and low manufacturing cost and being convenient to install, use and maintain. The lamp housing and the bulb fixing bracket of the lamp of the present invention are engraved to be hollow around its portion connected to the pipe bracket, to conveniently enable a cable to pass by, and a chimney effect may be formed in the lamp housing to improve the ventilating and radiating effects. The lamp post of the present invention has a flex which is suitable for such environments with complicated installation conditions as parks, gardens and the like. In the present invention, during maintenance, the LED bulb or the installation interface bracket combined member may be maintained just by detaching the lamp housing without integrally detaching the LED street lamp, so that the maintenance is convenient.

The meanings of the reference numerals in the embodiment are as follows: 101—lamp housing, 102—LED bulb, 103—radiator, 104—lamp housing fixing screw, 105—bulb fixing screw, 106—lighting fitting fixing flange, 108—pipe bracket, 110—lamp housing or bulb fixing bracket, 116—lamp post, 301—bulb installation flange fixing hole, 302—bracket lining rivet hole, 501—bracket lining rivet projection, and 502—power supply or control end welding spot hole.

Embodiment 5

Figure 59:
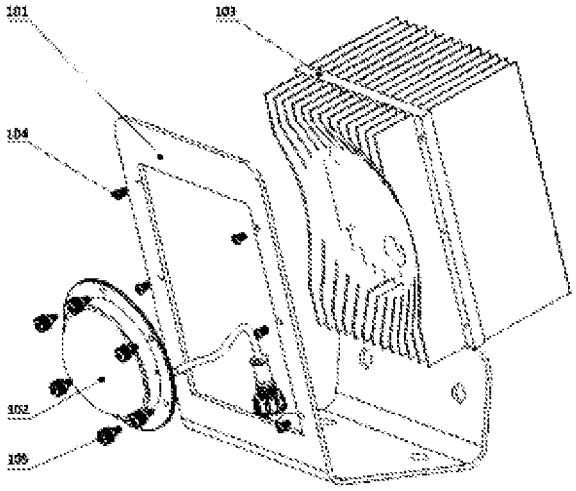
FIG. 59 is a schematic diagram of a structure of embodiment 5 in the present invention.
Figure 60:
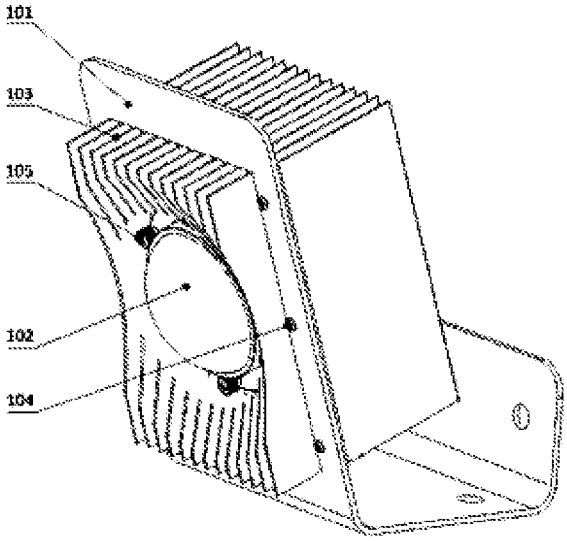
FIG. 60 is an external view of embodiment 5 of the present invention.
Figure 62:
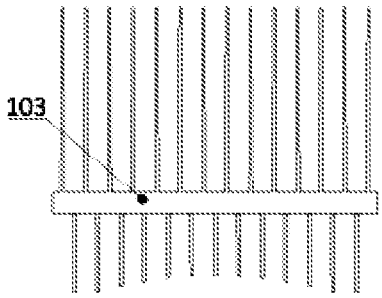
FIG. 62 is a cross-section diagram of a double-faced radiator in embodiment 5 of the present invention.

An LED tunnel lamp using a double-faced radiator and a lamp housing bracket structure, as shown in FIG. 59 and FIG. 60, including a lamp housing 101 formed by a metal stamping or plastics die casting process, wherein the lamp housing 101 includes an installation interface bracket plate used for installing a double-faced radiator 103 and a foot screw hole used for fixedly installing the entire LED tunnel lamp; one or more rectangular opening used for installing the double-faced radiator 103 is provided to the installation interface bracket plate, an installation interface is provided to the double-faced radiator 103, and an LED bulb 102 with waterproof and dustproof functions is provided on the installation interface. The double-faced radiator 103 includes a substrate, and fins are provided on both sides of the substrate; the installation interface used for installing the LED bulb 102 is provided on one side of the substrate, and circular or elliptic conical spaces are formed by cutting the fins around the installation interface of the substrate according to the illumination angle of the light emitted by the bulb to the extent of not shading the light emitted by the LED bulb 102, as shown in FIG. 62; the side on which the installation interface is provided of the double-faced radiator 103 penetrates through the rectangular opening; the installation interface includes a surface in contact with the LED bulb 102 and a hole connected to the LED bulb on the double-faced radiator 103. 6 flange fixing holes on the installation interface are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, and the double-faced radiator 103 is installed on the lamp housing through a lamp housing fixing screw 104.

Figure 63:
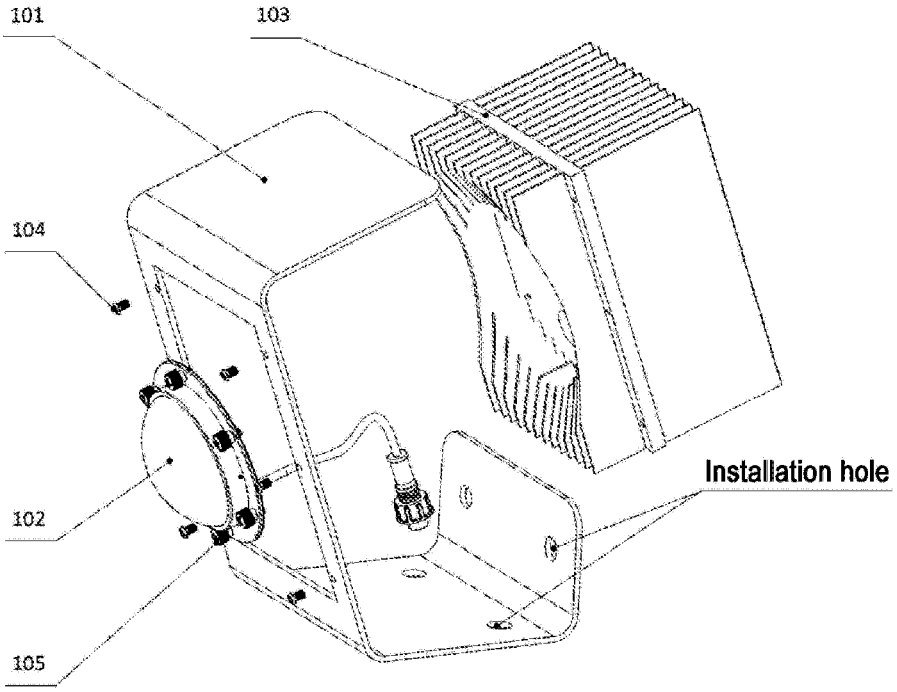
FIG. 63 is a structure diagram when a protection plate is adopted in embodiment 5 of the present invention.

Aiming at extremely severe environment in use, the lamp housing 101 of the present invention is further provided with a protection plate, as shown in FIG. 63.

Figure 64:
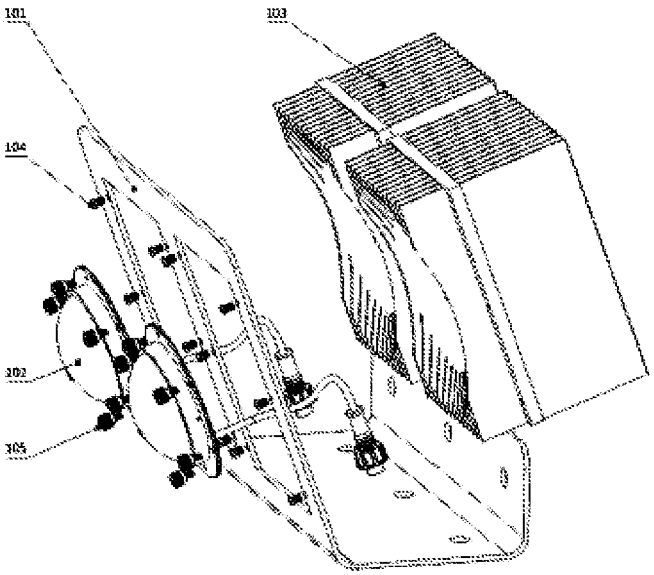
FIG. 64 is a structure diagram when a plurality of LED bulbs are adopted in embodiment 5 of the present invention.
Figure 65:
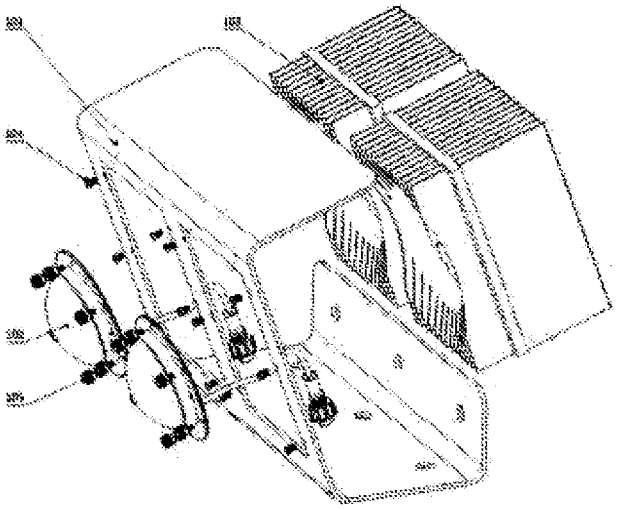
FIG. 65 is a structure diagram when a plurality of LED bulbs and a protection plate are adopted in embodiment 5 of the present invention.

Aiming at the environment with particular requirements on light intensity in use, a plurality of LED bulbs may also be adopted in the present invention, as shown in FIG. 64 and FIG. 65.

Figure 61:
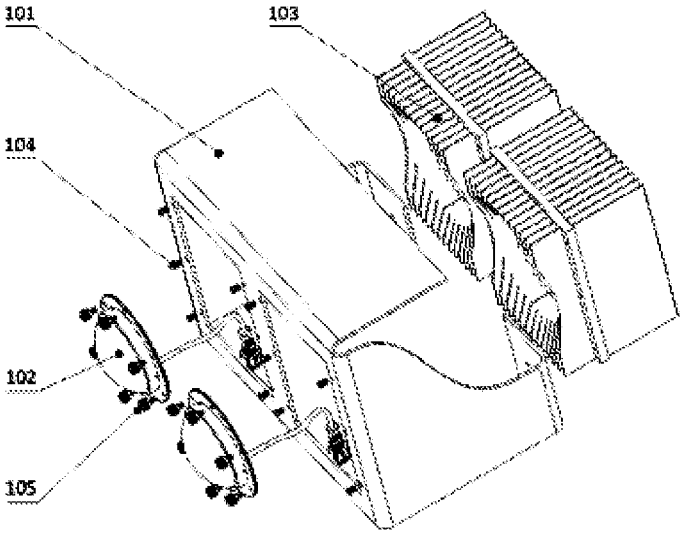
FIG. 61 is a structure diagram when a plurality of LED bulbs, a transverse installation bracket plate and a protection plate are adopted in embodiment 5 of the present invention.
Figure 66:
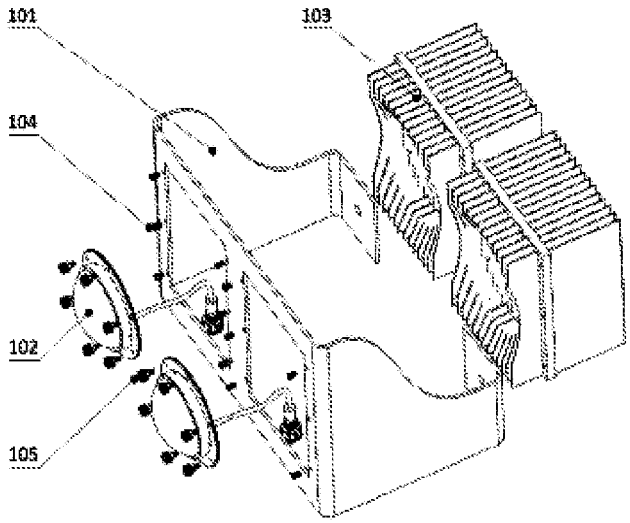
FIG. 66 is a structure diagram when a transverse installation bracket plate is adopted in embodiment 5 of the present invention.

Aiming at the environment with particular requirements on vertical ventilation in use, a transverse installation bracket plate may also be adopted in the present invention, as shown in FIG. 66 and FIG. 61.

The lamp housing of the lamp in the embodiment is additionally provided with the function of the original installation interface bracket, and the double-faced radiator, the LED bulb and other auxiliary components are overall collectively installed and fixed to the lamp housing, thus the LED tunnel lamp is simple, practical and aesthetic. When the double-faced radiator of the present invention is in operation, upper and lower fins are at two different heat working states, and heavy pollution of the fins on any single surface will not cause ineffectiveness of the radiator; the double-faced radiator of the tunnel lamp in the present invention has a large radiating area, meanwhile each part of the double-faced radiator is close to the heat source, so the utilization of the radiating metal is very high, nearly each gram of metal becomes the component of the extrusion type radiator, the entire metal dosage is about 50% less than that of the radiator of the traditional LED street lamp, thus the consumption of the metal material is greatly reduced.

The meanings of the reference numerals in the embodiment are as follows: 101—lamp housing, 102—LED bulb, 103—double-faced radiator, 104—lamp housing fixing screw, 105—bulb fixing screw, 301—bulb installation flange fixing hole, 302—bracket lining rivet hole, 501—bracket lining rivet projection, and 502—power supply or control end welding spot hole.

Embodiment 6

Figure 67:
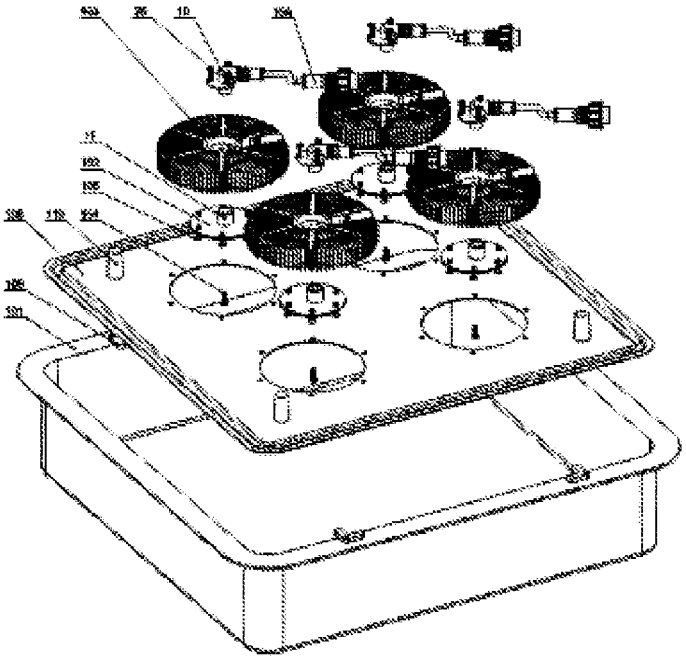
FIG. 67 is a schematic diagram of a structure of embodiment 6 of the present invention.
Figure 68:
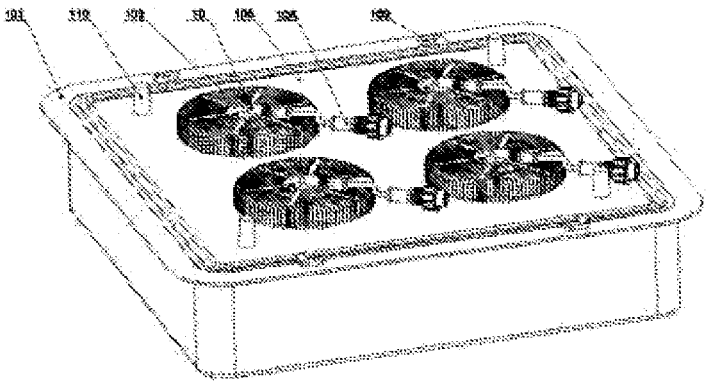
FIG. 68 is a vertical view of a structure of embodiment 6 of the present invention.
Figure 69:
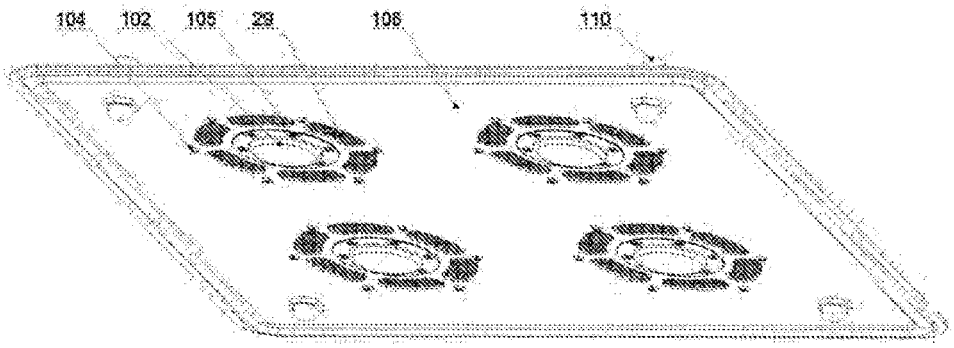
FIG. 69 is a schematic diagram of a structure when a ceiling lamp base with a vent hole is adopted in embodiment 6 of the present invention.
Figure 70:
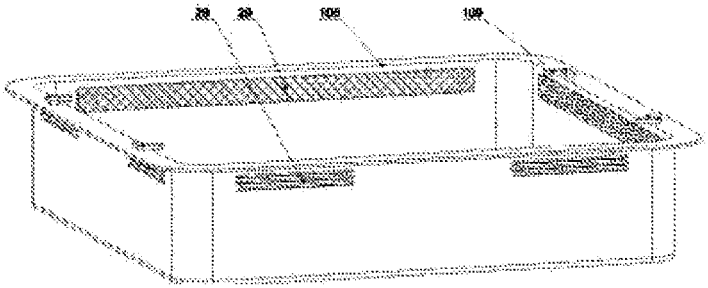
FIG. 70 is a schematic diagram of a structure of a ceiling lamp cover with a vent hole in embodiment 6 of the present invention.
Figure 71:
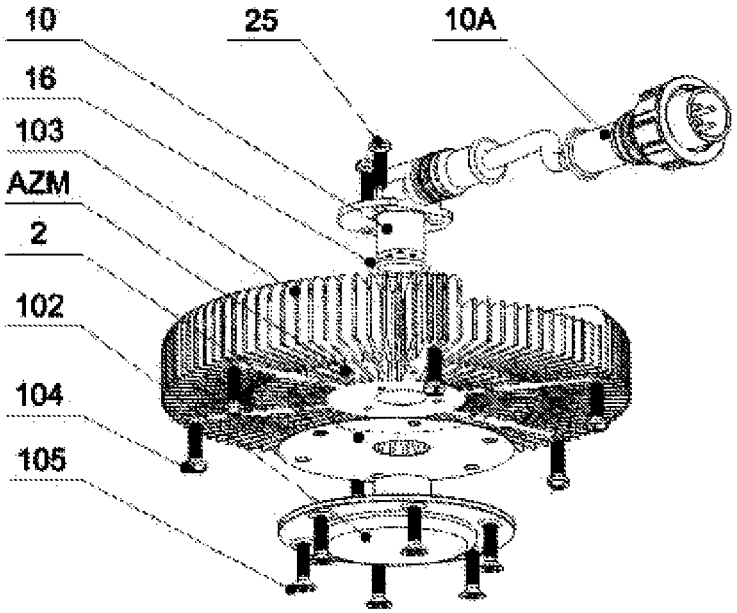
FIG. 71 is an installation drawing of an LED bulb in embodiment 6 of the present invention.

A multi-light source LED ceiling lamp, as shown in FIG. 67, FIG. 68 and FIG. 71, includes a ceiling lamp fitting, wherein the ceiling lamp fitting includes a ceiling lamp base 106 and a radiator 103; a base supporting pad 110 is provided at the edge of the ceiling lamp base 106 and is used to guarantee an enough ventilation distance between the ceiling lamp base 106 and the ceiling; a plurality of openings used for installing radiators are provided to the ceiling lamp base 106, and a radiator 103 is provided to each opening; an installation interface AZM is provided at the lower part of each radiator 103 for fixedly installing an LED bulb 102. The ceiling lamp fitting further includes a ceiling lampshade 101, a lampshade fixing clip 109 is provided at the edge of the ceiling lampshade 101, and the lampshade fixing clip 109 is used for installing the ceiling lampshade 101 on the ceiling lamp base 106; the installation interface AZM includes a surface in contact with the LED bulb 102 and a hole connected to the LED bulb, on the radiator 103. The ceiling lamp fitting further includes a connector assembly; the connector assembly includes a connector socket 10, a connector socket fixing screw 25 and an adjusting rubber pad 24; the connector socket 10 is cooperatively connected to a connector plug 11 on the LED bulb 102, a three-hole flange is provided on the connector socket 10, the connector socket is fixed with the radiator 103 through the three-hole flange and the connector socket fixing screw 25, and the fixed adjusting rubber pad 24 is further provided between the flange and the radiator 103 to ensure the tightness of a waterproof surface. 6 flange fixing holes on the installation interface AZM of the radiator 103 are uniformly distributed at a diameter D1, and the diameter D1 is a value obtained by subtracting a diameter of a fixing screw cap and then subtracting a margin of 0.8-4 mm from the outer diameter D of the LED bulb 102. The radiator 103 is a sunflower radiator. The radiator 103 is installed on the installation interface through a fixing screw 104, and the LED bulb 102 is installed on the installation interface AZM through a bulb fixing screw 105.

When the present invention is maintained, only the ceiling lampshade 101 is needed to open, and the fixing screw 105 is detached to change the LED bulb 102, thus prolonging the service life of the ceiling lamp and reducing the expected investment cost of user lighting.

The lamp in the embodiment uses the ceiling lamp base as the core, and the LED bulb and all of other auxiliary components are collectively installed on the ceiling lamp base, thus the structure is simple, the manufacturing cost is low, and the installation, use and maintenance are convenient. A vent hole A is provided at the edge of the bulb installation interface hole of the ceiling lamp base, external air may form convection with the longitudinal direction of the radiator through the vent hole to reinforce the radiating effect, the vent hole A is coated with a gauze to prevent insects from entering; a vent hole B is provided around the ceiling lampshade, and external air may enter from the vent hole A and flow out from the vent hole B to reinforce the radiating effect; the vent hole B is covered with the gauze to prevent insects from entering. The lamp in the embodiment has very strong radiating capability, so that the LED bulb may be used in the ceiling lamp needing strong radiating capability. In the present invention, a plurality of light sources are adopted to adapt to various indoor occasions with higher requirements on light.

The meanings of the reference numerals in the embodiment are as follows: 101—ceiling lampshade, 102—LED bulb, 103—radiator, 104—fixing screw, 105—bulb fixing screw, 106—ceiling lamp base, 109—lampshade fixing clip, 110—base supporting pad, and 301—bulb installation flange fixing hole.

Embodiment 7-1

Figure 72:
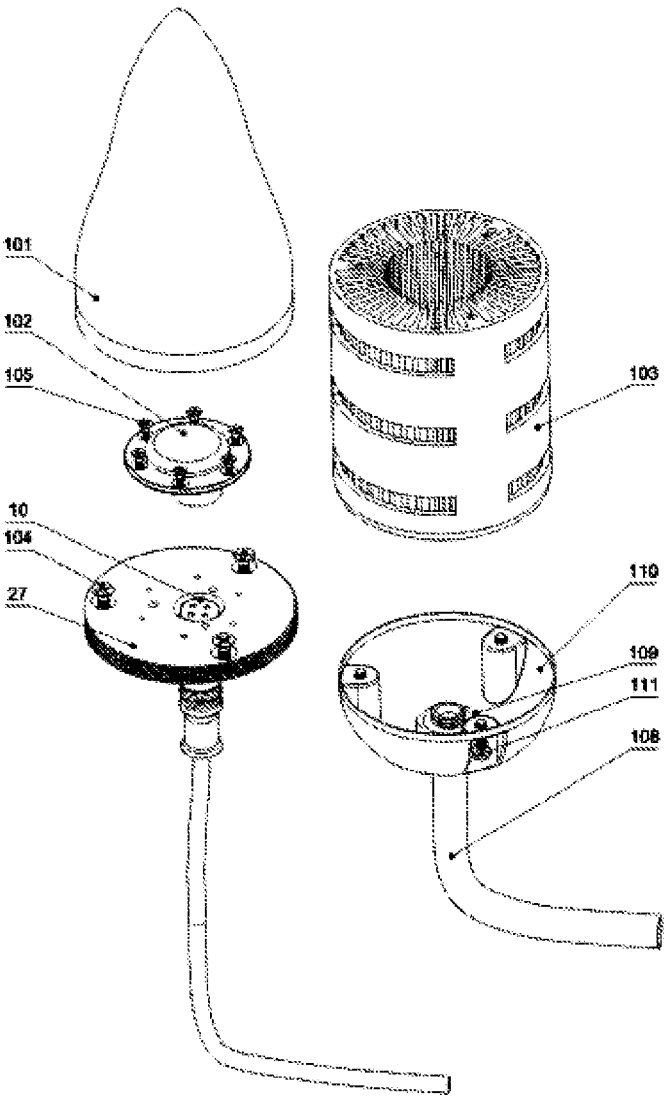
FIG. 72 is a schematic diagram of structures of embodiment 7-1 in the present invention.
Figure 74:
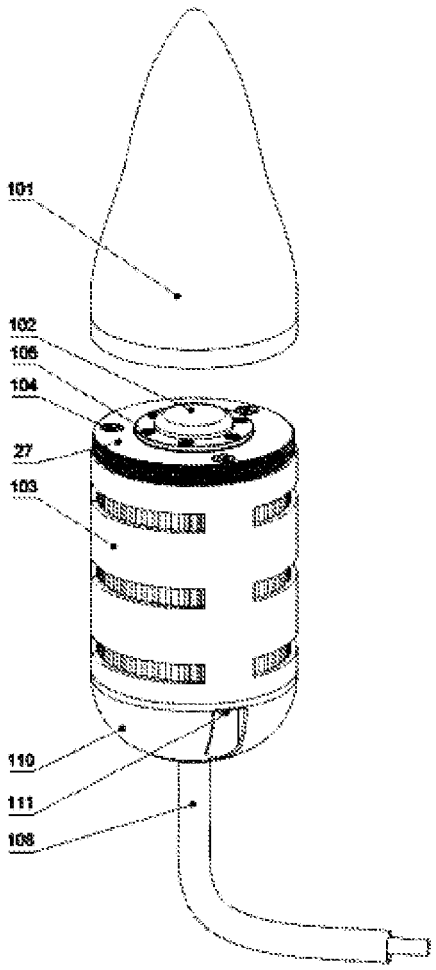
FIG. 74 is an external view of embodiment 7-1 of the present invention.

An LED candle lamp, as shown in FIG. 72 and FIG. 74, includes a candle lamp fitting, wherein the candle lamp fitting includes a heat conductive converting plate 27 and a radiator 103; an installation interface AZM is provided to the heat conductive converting plate 27 to fixedly install an LED bulb 102, and a heat conductive pad 2 is provided between the LED bulb 102 and the heat conductive converting plate 27; the heat conductive converting plate 27 is connected to a candle lamp housing 101 by adhesion, threaded connection or clamping manner, and the radiator 103 is provided beneath the heat conductive converting plate 27. The candle lamp fitting further includes a spool 108 and an intermediate connecting element 110, wherein the spool 108 is fixed to the intermediate connecting element 110 through a spool fixing screw 109, and the intermediate connecting element 110 is connected to the radiator 103 through a lamp cap fixing screw 111; the installation interface includes a surface in contact with the LED bulb 102 and a hole connected to the LED bulb, on the heat conductive converting plate 27. The radiator 103 is a columnar radiator and is internally hollow, the radiator 103 is provided with a radiator substrate at the maximal outer diameter of the cylinder and is provided with fins towards the center of the cylinder in a radial manner, two or more layers of interrupted grooves are provided to the columnar radiator along an enclosed arc at a thickness of the substrate, and after the radiator is heated, external air flows into the center of the radiator through the interrupted grooves to form convection so as to achieve a cooling effect. The candle lamp fitting further includes an electric connector assembly, the electric connector assembly includes a connector socket 10, a connector socket fixing screw 25 and a fixed adjusting rubber pad 24; the connector socket 10 is cooperatively connected to a plug 11 on the LED bulb, a three-hole flange is provided to the connector socket 10, the connector socket is fixed with the heat conductive converting plate 27 through the three-hole flange and the connector socket fixing screw 25, and the fixed adjusting rubber pad 24 is further provided between the flange and the heat conductive converting plate 27 to ensure the tightness of a waterproof surface; when the LED bulb 102 is installed, electrical connection of the LED bulb is achieved as long as the connector plug 11 is in butt joint with the connector socket 10 and the LED bulb 102 is fixed; a conducting wire led out from the connector socket 10 is guided to a power supply and a control circuit through the spool 108. 6 flange fixing holes on the installation interface AZM of the heat conductive converting plate 27 are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, and the radiator 103 is installed on the heat conductive converting plate 27 via a radiator fixing screw hole 104A thereon by means of a fixing screw 104.

Embodiment 7-2

Figure 73:
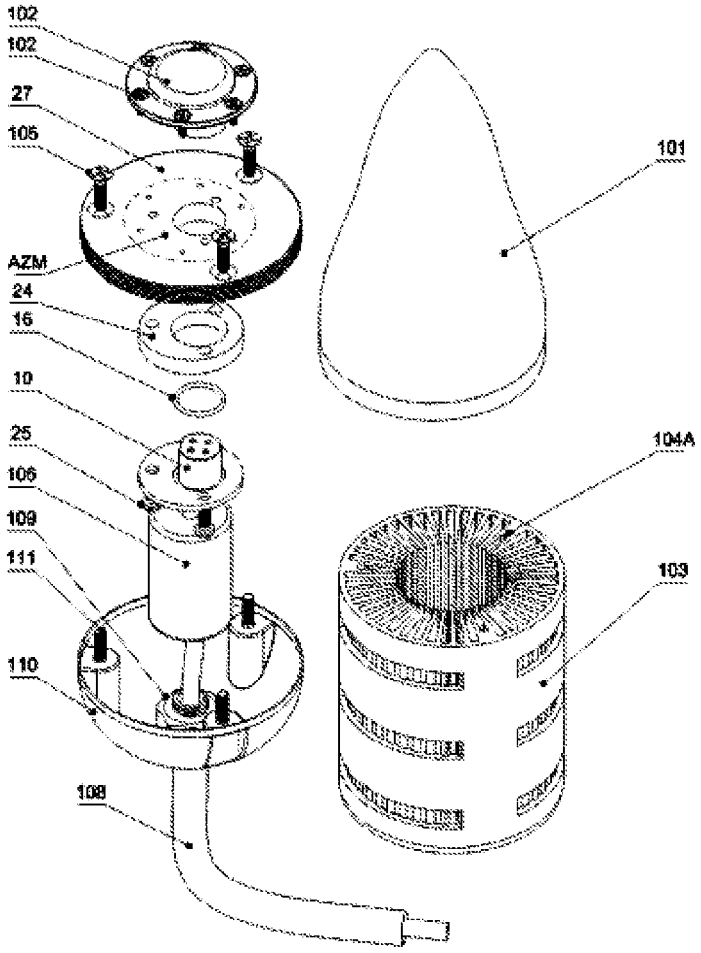
FIG. 73 is a schematic diagram of a structure of embodiment 7-2 in the present invention.
Figure 75:
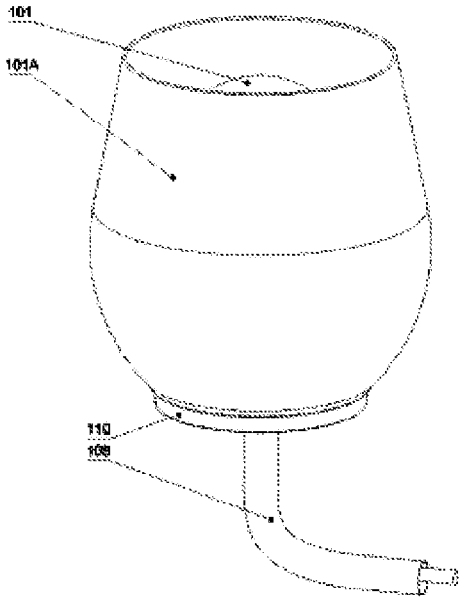
FIG. 75 is a use state diagram when an outer lampshade is adopted in embodiment 7 of the present invention.

An LED candle lamp, as shown in FIG. 73 and FIG. 75, includes a candle lamp fitting, wherein the candle lamp fitting includes a heat conductive converting plate 27 and a radiator 103; an installation interface AZM is provided to the heat conductive converting plate 27 to fixedly install an LED bulb 102, and a heat conductive pad 2 is provided between the LED bulb 102 and the heat conductive converting plate 27; the heat conductive converting plate 27 is connected to a candle lamp housing 101 by adhesion, threaded connection or clamping manner, and the radiator 103 is provided beneath the heat conductive converting plate 27. The candle lamp fitting further includes a spool 108 and an intermediate connecting element 110, wherein the spool 108 is fixed with the intermediate connecting element 110 through a spool fixing screw 109, and the intermediate connecting element 110 is connected to the radiator 103 through a lamp cap fixing screw 111; the installation interface includes a surface in contact with the LED bulb 102 and a hole connected to the LED bulb on the heat conductive converting plate 27. The radiator 103 is a columnar radiator and is internally hollow, the radiator 103 is provided with a radiator substrate formed inwards from the maximal outer diameter of the cylinder and is provided with fins formed towards the center of the cylinder in a radial line, two or more layers of interrupted grooves are provided on the columnar radiator along a sealed circular arc at a thickness of the substrate, after the radiator is heated, external air flows into the center of the radiator through the interrupted grooves to form convection so as to achieve a cooling effect. The candle lamp fitting further includes a connector assembly, the connector assembly includes a connector socket 10, a connector socket fixing screw 25 and a fixed adjusting rubber pad 24; the connector socket 10 is cooperatively connected to a plug 11 on the LED bulb, a three-hole flange is provided to the connector socket 10, the connector socket is fixed with the heat conductive converting plate 27 through the three-hole flange and the connector socket fixing screw 25, and the fixed adjusting rubber pad 24 is further provided between the flange and the heat conductive converting plate 27 to ensure tightness of a waterproof surface; when the LED bulb 102 is installed, electrical connection of the LED bulb is achieved as long as the connector plug 11 is in butt-joint with the connector socket 10 and the LED bulb 102 is fixed; a conducting wire led out from the connector socket 10 is guided to a driving power supply 106 and is guided to a power supply and a control circuit through the spool 108, and the driving power supply 106 is provided in the hollow part of the radiator 103. 6 flange fixing holes on the installation interface AZM of the heat conductive converting plate 27 are uniformly distributed at a diameter D1, and the diameter D1 is a value obtained by subtracting a diameter of a fixing screw cap and then subtracting a margin of 0.8-4 mm from the outer diameter D of the LED bulb 102. The LED bulb 102 is installed on the installation interface through a bulb fixing screw 105, and the radiator 103 is installed on the heat conductive converting plate 27 via a radiator fixing screw hole 104A thereon by means of a fixing screw 104.

Figure 79:
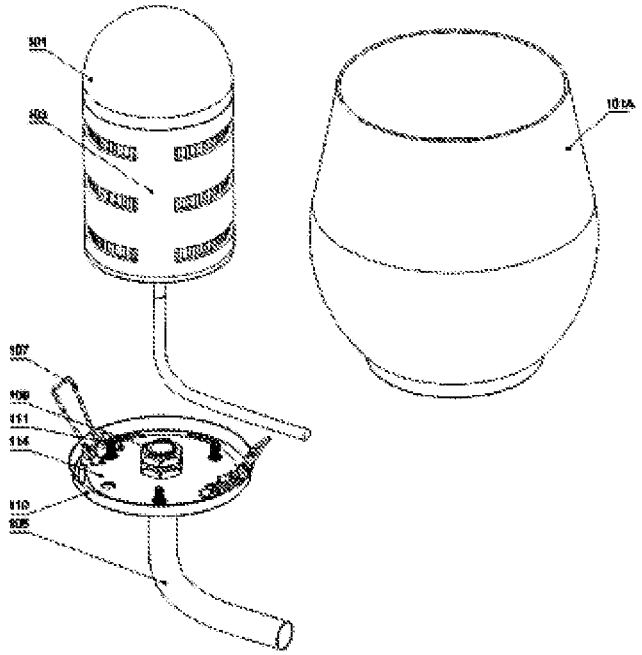
FIG. 79 is a schematic diagram of a structure when an outer lampshade is adopted in embodiment 7 of the present invention.
Figure 80:
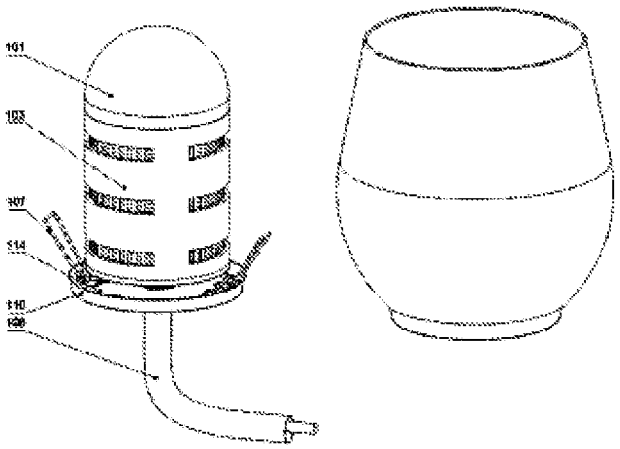
FIG. 80 is an external view when an outer lampshade is adopted in embodiment 7 of the present invention.
Figure 81:
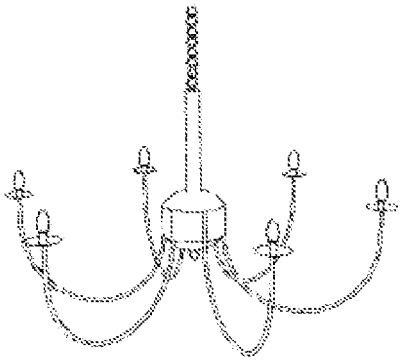
FIG. 81 is an LED candle-shaped ceiling lamp constructed by a candle-shaped lamp in embodiment 7 of the present invention.

In the embodiment of the present invention, the candle lamp housing 102 may also be provided with an outer lampshade 101A, and the outer lampshade 101A is fixed to the intermediate connecting element 110 through a spring fixing clip 107, as shown in FIG. 75, FIG. 79 and FIG. 80.

In the embodiment, the intermediate connecting element 110 may be connected to the radiator 103 through threads thereon or in a direct adhesion manner.

Figure 82:
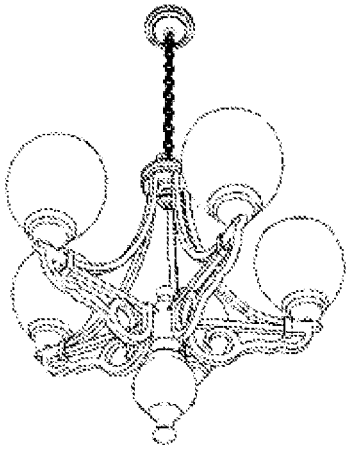
FIG. 82 is an LED candle-shaped ceiling lamp constructed by a candle-shaped lamp with an outer lampshade in embodiment 7 of the present invention.
Figure 83:
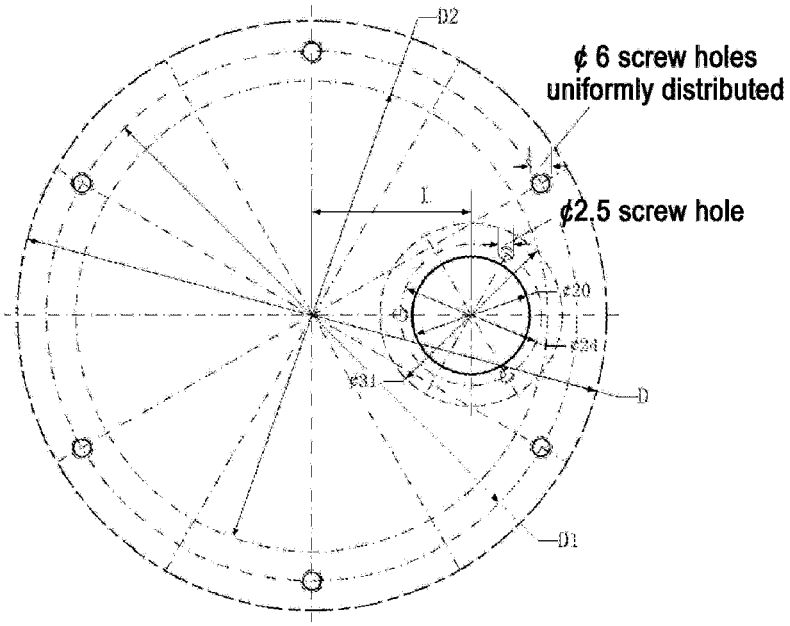
FIG. 83 is a schematic diagram of an installation interface on a lamp in an embodiment of the present invention (for bulbs with outside diameters of 80 mm or larger)
Figure 84:
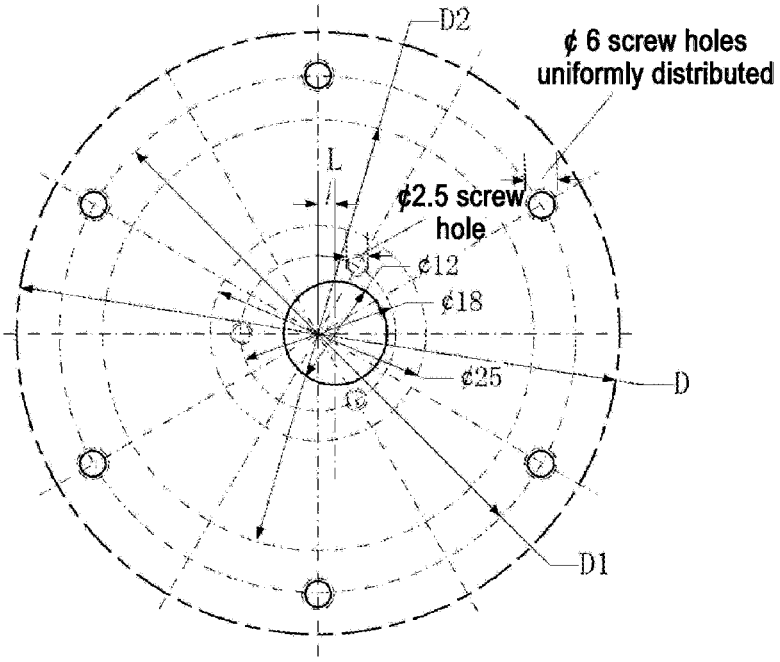
FIG. 84 is a schematic diagram of an installation interface on a lamp in an embodiment of the present invention (for bulbs with outside diameters of 70 mm or larger).

In an LED candle type pendant lamp using the structural form of the candle lamp in the present invention, the LED bulb 102 is fixed to the installation interface (the installation interface is provided on a surface in contact with the LED bulb 102 and a hole connected to the LED bulb on the heat conductive converting plate 27, and the connector socket 10 is fixed to the heat conductive converting plate 27) of the candle lamp through a flange and a fixing screw 105, and a plurality of candle lamps may be assembled into the LED candle type pendant lamp, as shown in FIG. 22; in the LED candle type pendant lamp using the structural form of the candle lamp of the present invention, the outer lampshade 101A is provided outside the candle lamp provided with the spring fixing clip 107, the LED bulb 102 is fixed to the installation interface (the installation interface is provided on a surface in contact with the LED bulb 102 and a hole connected to the LED bulb on the heat conductive converting plate 27, and the connector socket 10 is fixed to the heat conductive converting plate 27) of the candle lamp through the flange and the fixing screw 105, and a plurality of candle lamps with the outer lampshades (101A) may be used for constructing the LED candle type pendant lamp, as shown in FIG. 82.

Figure 76:
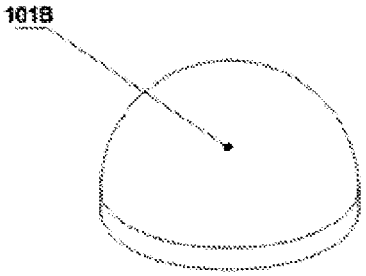
FIG. 76 is a schematic diagram of a style when an outer lampshade is hemispherical in embodiment 7 of the present invention.
Figure 77:
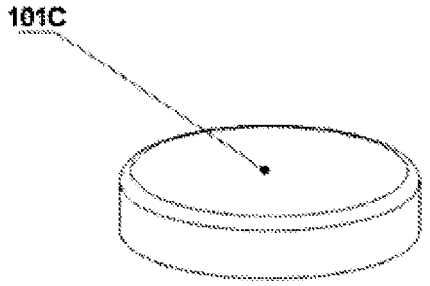
FIG. 77 is a schematic diagram of a style when an outer lampshade is a flat lampshade in embodiment 7 of the present invention.
Figure 78:
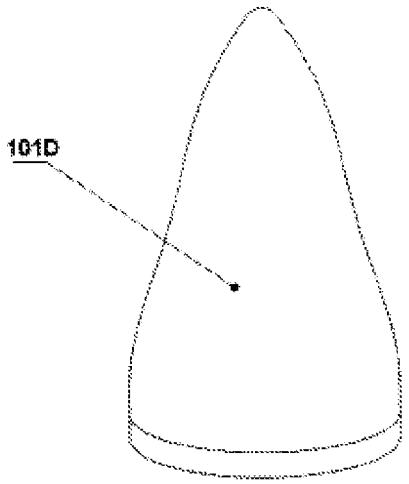
FIG. 78 is a schematic diagram of a style when an outer lampshade is a candle-shaped lampshade in embodiment 7 of the present invention.

In the embodiment of the present invention, the outer lampshade 101A may be a hemispherical lampshade 101B, a flat lampshade 101C or a candle lampshade 101D, as shown in FIG. 76, FIG. 77 and FIG. 78.

The meanings of the reference numerals in the embodiment are as follows: 101—candle lamp housing, 101A—outer lampshade, 101B—hemispherical lampshade, 101C—flat lampshade, 101D—candle lampshade, 102—LED bulb, 103—radiator, 104—fixing screw, 104A—radiator fixing screw hole, 105—bulb fixing screw, 106—driving power supply, 107—spring fixing clip, 108—spool, 109—spool fixing screw, 110—intermediate connecting element, 111—connecting screw, and 301—bulb installation flange fixing hole.

The invention claimed is:

1. A method for constructing a universal LED bulb, comprising:

supporting an optical engine core member of the LED bulb using a lens snap ring as a supporting main body of the LED bulb; and using a light distribution optical lens as an auxiliary supporting structure of the LED bulb, and further using the light distribution optical lens as an installation base of the optical engine core member of the LED bulb or using the light distribution optical lens as an installation base of an LED bulb radiator in cooperation with an inner snap ring, wherein an installation flange is provided to the lens snap ring for installing the LED bulb; the LED bulb optical engine core member comprises a heat conductive bracket, an optical engine module, the inner snap ring and the light distribution optical lens, wherein an inner cover is provided outside the optical engine module, and an electric connector is provided to the heat conductive bracket; the optical engine module comprises an optical engine die plate, an LED chip set and a relevant wiring by bonding and packaging, or is further integrated with a power supply drive chip.

2. The method for constructing the universal LED bulb of claim 1, wherein the diameter of the lens snap ring is a bulb outer diameter D, the LED bulb outer diameter D and an upper limit of power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outer diameters D, in order to improve interchangeability and universality of the LED bulbs; on the relationship curve $W=1.1812e^{0.0361D}$, with 20 mm used as a lower limit of the LED bulb outer diameter D and 130 mm used as an upper limit, the relationship curve is divided into 12 segments each of which is set to 10 mm to form a limited number of bulb outer diameter specifications, and interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the LED bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the LED bulb outer diameter D; and the installation interface of the LED bulb includes a surface in contact with the LED bulb and a hole connected to the LED bulb on the lamp.

3. The method for constructing the universal LED bulb of claim 1, wherein a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by low temperature extrusion moulding and high temperature sintering of an ultrafine nonmetal, contact surfaces of the nonmetal radiator and the heat conductive conversion bracket are adhered into an integral piece by being coated with a heat conductive adhesive; a rubber sheath or screw fixing glue is filled in the fixing screw hole of the nonmetal radiator for connecting a fixing screw, and a radiator outer cover is provided outside the nonmetal radiator; the heat conductive conversion bracket is overhead, the nonmetal radiator has a screen mesh structure, and the nonmetal radiator is kept overhead by the heat conductive conversion bracket, so that the air is able to enter the screen mesh of the nonmetal radiator from the heat conductive conversion bracket; or the radiator is a metal radiator, the metal radiator has a hollow structure, a foam metal is filled in the hollow part, superconductive liquid is filled in the hollow structure, upper and lower stoppers are pressed by interference fit or screwed by a threaded seal gum into the hollow structure to form a sealed space, and the sealed space is vacuumized; the fixing screw of the radiator penetrates through a fixing through hole on the inner snap ring to be connected to the fixing screw hole of the nonmetal radiator or the metal radiator.

4. The method for constructing the universal LED bulb of claim 1, wherein a connector plug fixing hole is provided to the heat conductive bracket, a connector plug with a contact pin is inserted into the connector plug fixing hole and is fixed with the part inserted into the LED bulb as a fixed end, a tail end of the contact pin is welded to the optical engine die plate in the universal LED bulb, to form a simple electrical interface on the outer surface of the universal LED bulb, during installation, electrical connection of the universal LED bulb is achieved as long as the connector plug is butt-jointed with the connector socket with a cable and the universal LED bulb is fixed; an eccentric position of the hole of the connector plug on the heat conductive bracket and a size of the fixed end of the connector plug are defined, such that the optical engine die plate in the LED bulb may meet the demands of arranging the LED chip and the power supply drive chip and registering them; the connector plug with the contact pin is of a four-pin structure in which two pins are used for power supply access and the other two pins are used for control access; the fixed end is formed in a nut fixing manner or a fusion ring fixing manner; when the fixed end is formed in the nut fixing manner, a waterproof rubber ring is added between the connector plug and the heat conductive bracket to prevent water; in order to prevent rotation, an antiskid groove is provided in the connector plug, and a corresponding projection is provided at the through hole of the heat conductive bracket; a three-hole flange is provided to the connector socket and is fixed to the lamp radiator through a fixing screw, and an adjusting rubber pad is provided between the connector socket and the radiator to adjust the thickness, in order to ensure tightness of a waterproof surface; or external threads are provided to the connector plug to match with the internal threads of the fixing nut on the connector socket provided with the waterproof rubber ring to prevent water; a slot is provided to the connector socket, and the waterproof rubber ring is provided in the slot to prevent water.

5. A snap ring lens type LED bulb, comprising a lens snap ring (8) with an installation flange, wherein an optical engine core member of the LED bulb is supported using the lens snap ring (8) as a supporting main body of the LED bulb, and a light distribution optical lens (7) is used as an auxiliary supporting structure of the LED bulb, and the light distribution optical lens (7) is further used as an installation base of the optical engine core member of the LED bulb or the light distribution optical lens (7) is used as an installation base of an LED bulb radiator in cooperation with an inner snap ring (81); wherein at least a heat conductive bracket (3), an optical engine module (4) and the light distribution optical lens (7) are provided inside the lens snap ring (8) sequentially, a groove with a step is provided to the light distribution optical lens (7), the heat conductive bracket (3) is adhered in the step, the optical engine module (4) is adhered on the heat conductive bracket (3), a connector plug (11) is fixed to the heat conductive bracket (3), an inner cover (6) is provided outside the optical engine module (4), or an inner ring cover (62) is further provided between the groove edge of the light distribution optical lens (7) and the inner cover (6), the optical engine module (4) is enclosed in a sealed waterproof space between the heat conductive bracket (3) and the light distribution optical lens (7), and when the lens snap ring (8) is installed, it can be ensured an upper surface of the heat conductive bracket (3) tightly abut on a radiator (103); or, the inner snap ring (81) surrounds the optical engine module (4), the upper part of the inner snap ring (81) is adhered to the heat conductive bracket (3), a lower end thereof is provided with a radiator fixing through hole (23), a pressure pad is provided in the fixing through hole (23) to prevent water and for preventing a radiator fixing screw from crushing the heat conductive bracket; the optical engine module (4) comprises an optical engine die plate, an LED chip set and a relevant wiring by bonding and packaging, or is further integrated with a power supply drive chip; or, the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

6. The snap ring lens type LED bulb of claim 5, wherein the radiator (103) is provided to the heat conductive bracket (3), and a heat conductive pad (2) is provided between the radiator (103) and the heat conductive bracket (3); the radiator (103) is a nonmetal radiator assembly, the nonmetal radiator assembly includes a screen mesh-shaped nonmetal radiator and an overhead heat conductive conversion bracket (1) at the lower side thereof, a rubber sheath or screw fixing glue is filled in the radiator fixing screw hole (33) of the nonmetal radiator for connecting a fixing screw, and a radiator outer cover (101) is provided outside the nonmetal radiator; or the radiator (103) is a metal radiator, the metal radiator includes a cooling fin (34), a superconductive fluid cavity is provided at the middle of the cooling fin (34), a foam metal (37) is filled in the superconductive fluid cavity and superconductive fluid is filled therein, an upper stopper (33) and a lower stopper (35) are provided on both ends of the superconductive fluid cavity, and a vacuum suction pipe (32) is provided to the upper stopper (33) or the lower stopper (35); a cable hole (36) used for penetration of a cable and a radiator fixing screw hole (38) are further provided to the radiator (103), and a radiator fixing screw (12) connected to the radiator fixing screw hole (38) penetrates through the inner snap ring (81) and the fixing through hole on the heat conductive bracket (3), such that the LED bulb radiator (103) is fixed on the heat conductive bracket (3) and the light distribution optical lens (7).

7. The snap ring lens type LED bulb of claim 5, wherein only transparent silica gel for package is provided outside the LED chip on the optical engine module (4), the inner cover (6) is provided outside the optical engine module (4) with the transparent silica gel, and fluorescent powder coating is provided on the inner layer of the inner cover (6); or, no silica gel is packaged on the LED chip on the optical engine module (4), a concave inner cover filled with transparent insulating heat conductive liquid is provided outside the optical engine module (4), the LED chip on the optical engine module (4) is soaked in the transparent insulating heat conductive liquid, fluorescent powder is provided in the transparent insulating heat conductive liquid, and the concave inner cover is an elastic inner cover of a thin concave structure.

8. The snap ring lens type LED bulb of claim 5, wherein an electric connector is provided to the heat conductive bracket (3), the connector includes a connector plug (11), a contact pin (17) is provided to the connector plug (11), and a contact pin welding spot (19) on the tail end of the contact pin (17) is welded to the optical engine module (4); the connector plug (11) is provided to a fixed end (15) for fixing after penetrating through a fixing hole (22) of the connector plug on the universal LED bulb; the connector plug (11) is cooperatively connected to a connector socket (10) with a hole, and the connector socket (10) is connected to a cable; the contact pin of the connector has a four-pin structure in which two pins are used for power supply access and the other two pins are used for control access;

wherein the fixed end (15) is a fusion ring or the fixed end (15) is a fixing nut, a waterproof rubber ring slot (18) is further provided to the connector plug (11), and a waterproof rubber ring (16) is provided in the waterproof rubber ring slot (18); in order to prevent rotation, an antiskid groove (26) is provided to the connector plug (11), and a corresponding projection is provided at the through hole of the heat conductive bracket (3); a three-hole flange is provided to the connector socket (10), and the connector socket is fixed to the radiator (103) or a heat conductive converting plate (27) on the lamp through the three-hole flange and a connector socket fixing screw (25), and a fixed adjusting rubber pad (24) is further provided between the flange and the radiator (103) or the heat conductive converting plate (27) on the lamp to ensure tightness of a waterproof surface; or the connector plug (11) is provided with external threads which match with internal threads of the fixing nut (28) on the connector socket (10) provided with the waterproof rubber ring (16) to be fixed to the connector plug (11); a slot is provided to the connector socket (10), and the waterproof rubber ring (16) is provided in the slot.

9. A lamp using the LED bulb of claim 5, comprising an installation interface, wherein the LED bulb is provided on the installation interface.

10. The lamp of claim 9, wherein the lamp is an LED street lamp, the LED street lamp comprises an installation interface bracket (103A) punch-formed by sheet metal, an installation interface is provided on the installation interface bracket (103A), and the LED bulb (102) provided with a radiator is provided on the installation interface; the installation interface bracket (103A) is installed on a lamp post (108); a lamp housing (101) punch-formed by metal or die-casted by plastics is provided outside the installation interface bracket (103A).

11. The lamp of claim 10, wherein the installation interface bracket (103A) is an L-shaped bracket, the installation interface bracket (103A) is fixed to the lamp post (108) by an installation fixing bolt (109) through a bracket installation flange with an L-shaped side face; a cable hole is provided to an installation interface of the installation interface bracket (103A); the LED street lamp using the installation interface bracket structure further includes a wire harness connector (106), and the wire harness connector (106) is used for connecting a plurality of LED bulbs (102) to a power supply and a control circuit; the wire harness connector (106) is provided to the installation interface bracket (103A); the installation interface includes a surface in contact with the LED bulb (102) and a hole connected to the LED bulb on the installation interface bracket (103A);

or the installation interface bracket (103A) is a straight panel-shaped bracket, a bracket installation hole is provided at the center of the straight panel shape, and the installation interface bracket (103A) is installed on the lamp post (108) through the bracket installation hole and a lamp post fixing ring (116); the cable hole is provided to an installation interface of the installation interface bracket (103A); the LED street lamp using the installation interface bracket structure further comprises the wire harness connector (106), the wire harness connector (106) is used for connecting a plurality of LED bulbs (102) to the power supply and the control circuit, and the wire harness connector (106) is provided inside the lamp post (108) connected to the installation interface bracket (103A); the installation interface includes a surface in contact with the LED bulb (102) and a hole connected to the LED bulb on the installation interface bracket (103A).

12. The lamp of claim 9, wherein the lamp is an LED street lamp, the LED street lamp uses a lamp housing as an installation interface bracket structure and comprises the lamp housing (101) punch-formed by sheet metal; the lamp housing (101) includes a bracket panel folded to multiple pieces, an installation interface is provided to the bracket panel, and an LED bulb (102) is provided on the installation interface; the lamp housing (101) is fixed to a lamp post (108) through a lamp post fixing element.

13. The lamp of claim 12, further comprising a wire harness connector (106), wherein the wire harness connector (106) is provided to the lamp housing (101), and the wire harness connector (106) is used for connecting a plurality of LED bulbs (102) to a power supply and a control circuit;

wherein an edgefold for reinforcing the structural strength is provided at the edge of the lamp housing (101), and the installation interface includes a surface in contact with the LED bulb (102) and a hole connected to the LED bulb on the lamp housing (101); a lamp post fixing hole used for connecting the lamp post (108) is formed in an upper part of the lamp post fixing bracket (112);

wherein the lamp post fixing element includes a lamp post fixing bracket (112), a lamp post fixing bracket bolt (111) and a reinforcing plate (110), the lamp post fixing bracket (112) and the reinforcing plate (110) are provided on the upper and lower sides of the lamp housing (101), and the lamp housing (101) is fixed to the lamp post (108) through the lamp post fixing bracket (112) and the reinforcing plate (110); the lamp housing (101) includes three bracket panels which are folded to form angles, the lower part of the lamp post fixing bracket (112) is a planar bracket, and the lamp post fixing bracket (112) is fixed to the bracket panel at the center of the lamp housing (101) from the upper side or the lower side of the lamp housing (101); or, the lamp housing (101) includes two bracket panels which are folded to form an angle, the lamp post fixing bracket (112) is fixed to the bracket panels provided to form the angle from the upper side or the lower side of the lamp housing (101), and a triangular bracket is provided at the lower part of the lamp post fixing bracket (112) and is inverted V-shaped or V-shaped.

14. The lamp of claim 9, wherein the lamp is an LED street lamp, an extrusion type radiator is used as a lamp main body structure, the LED street lamp comprises a metal extrusion type radiator (103) formed by an extrusion process and a wire harness connector (106), and the extrusion type radiator (103) is fixed to a lamp post (108); the extrusion type radiator (103) includes a lamp post fixing sleeve, radiators are provided on both sides of the lamp post fixing sleeve, and an installation interface used for installing an LED bulb (102) is provided to the radiator; the LED bulb (102) is installed on the installation interface; the wire harness connector (106) is provided to the lamp post fixing sleeve, and the wire harness connector (106) is used for connecting a plurality of LED bulbs (102) to a power supply and a control circuit.

15. The lamp of claim 14, wherein the radiator includes a substrate, and fins are provided on one side of the substrate; the installation interface used for installing the LED bulb (102) is provided on the other side of the substrate; a conducting wire bracket (112) is provided on the other side of the substrate, and the conducting wire bracket (112) is used for connecting a conducting wire led out from the LED bulb (102) to the wire harness connector (106);

wherein the installation interface includes a surface in contact with the LED bulb (102) and a hole connected to the LED bulb on the radiator;

wherein in the extrusion type radiator (103), the radiators on both sides are provided to form an angle; a lamp post seal head (101) is provided on one end of the lamp post fixing sleeve, and the other end of the lamp post fixing sleeve is fixed to the lamp post (108) through a lamp post fixing screw (109).

16. The lamp of claim 9, wherein the lamp is LED street lamp, the LED street lamp comprises an installation interface bracket combined member, an LED bulb (102) provided with a radiator is provided to the installation interface bracket combined member; a lamp housing (101) punch-formed by metal or die-casted by plastics is provided outside the installation interface bracket combined member, and the installation interface bracket combined member is connected to a lamp post (116); the installation interface bracket combined member includes a pipe bracket (108) which is formed by segmenting a standard pipe, a lamp fixing flange (106) and a lamp housing and bulb fixing bracket (110), the pipe bracket (108), the lamp fixing flange (106) and the lamp housing and bulb fixing bracket (110) are connected, an installation interface used for installing the LED bulb (102) is provided to the lamp housing and bulb fixing bracket (110), and the pipe bracket (108) is connected to the lamp fixing flange (106) and the lamp housing and bulb fixing bracket (110); the installation interface bracket combined member is connected to the lamp post (116) through the lamp fixing flange (106).

17. The lamp of claim 16, wherein the installation interface comprises a surface in contact with the LED bulb (102) and a hole connected to the LED bulb on the lamp housing and bulb fixing bracket (110); the lamp housing and bulb fixing bracket (110) is punch-formed by metal, the pipe bracket (108) is connected to the center of the lamp housing and bulb fixing bracket (110), the lamp housing and bulb fixing bracket (110) are engraved to be hollow around its portion connected to the pipe bracket (108), so that passage of a cable and formation of a chimney effect in the lamp housing are facilitated to ensure the ventilating and radiating effects; the lamp fixing flange (106) is provided with a cable hole around its portion connected to the pipe bracket (108).

18. The lamp of claim 9, wherein the lamp is an LED tunnel lamp, the LED tunnel lamp comprises a lamp housing (101) formed by a metal stamping or plastics die casting process, the lamp housing (101) includes an installation interface bracket plate used for installing a double-faced radiator (103) and a foot screw hole used for fixedly installing the entire LED tunnel lamp; one or more rectangular openings used for installing the double-faced radiator (103) are provided to the installation interface bracket plate, an installation interface is provided to the double-faced radiator (103), and the LED bulb (102) is provided on the installation interface;

wherein a protection plate is further provided to the lamp housing (101);

wherein the double-faced radiator (103) includes a substrate, and fins are provided on both sides of the substrate; the installation interface used for installing the LED bulb (102) is provided on one side of the substrate, and circular or elliptic conical spaces are formed by cutting fins around the installation interface of the substrate according to the illumination angle of the light emitted by the LED bulb to the extent of not shading the light emitted by the LED bulb (102); the side on which the installation interface is provided of the double-faced radiator (103) penetrates through the rectangular openings; the installation interface includes a surface in contact with the LED bulb (102) and a hole connected to the LED bulb on the double-faced radiator (103).

19. The lamp of claim 9, wherein the lamp is an LED ceiling lamp, the LED ceiling lamp includes a ceiling lamp base (106) and a radiator (103), a base supporting pad (110) is provided at the edge of the ceiling lamp base (106) and is used to guarantee an enough ventilation distance between the ceiling lamp base and the ceiling; a plurality of openings used for installing radiators are provided to the ceiling lamp base (106), and the radiator (103) is provided to each opening; an installation interface (AZM) is provided at the lower part of each radiator (103) for fixedly installing the LED bulb (102).

20. The lamp of claim 19, wherein the LED ceiling lamp further comprises a ceiling lampshade (101), a lampshade fixing clip (109) is provided at the edge of the ceiling lampshade (101), and the lampshade fixing clip (109) is used for installing the ceiling lampshade (101) on the ceiling lamp base (106); the installation interface (AZM) includes a surface in contact with the LED bulb (102) and a hole connected to the LED bulb on the radiator (103);

wherein the LED ceiling lamp further includes an electric connector assembly; the electric connector assembly includes a connector socket (10), a connector socket fixing screw (25) and an adjusting rubber pad (24); the connector socket (10) is cooperatively connected to a connector plug (11) on the LED bulb (102), a three-hole flange is provided to the connector socket (10), the connector socket is fixed to the radiator (103) through the three-hole flange and the connector socket fixing screw (25), and a fixed adjusting rubber pad (24) is further provided between the flange and the radiator (103) to ensure tightness of a waterproof surface.

21. The lamp of claim 9, wherein the lamp is an LED candle lamp, the LED candle lamp includes a heat conductive converting plate (27) and a radiator (103); an installation interface (AZM) is provided to the heat conductive converting plate (27) to fixedly install the LED bulb (102); the heat conductive converting plate (27) is connected to a candle lamp housing (101) by adhesion, threaded connection or clamping manner, and the radiator (103) is provided beneath the heat conductive converting plate (27).

22. The lamp of claim 21, wherein the LED candle lamp further comprises a spool (108) and an intermediate connecting element (110), the spool (108) is fixed to the intermediate connecting element (110) through a spool fixing screw (109), and the intermediate connecting element (110) is connected to the radiator (103) through threads thereon, or through a lamp cap fixing screw (111) or in a direct adhesion manner; the installation interface includes a surface in contact with the LED bulb (102) and a hole connected to the LED bulb on the heat conductive converting plate (27);

wherein the radiator (103) is a columnar radiator and is internally hollow, the radiator (103) is provided with a radiator substrate formed inwards from the maximal outer diameter of the cylinder and is provided with fins formed towards the center of the cylinder in a radial manner, two or more layers of interrupted grooves are provided to the columnar radiator along an enclosed arc at a thickness of the substrate, and after the radiator is heated, external air flows into the center of the radiator through the interrupted grooves to form convection so as to achieve a cooling effect;

wherein the LED candle lamp further comprises an electric connector assembly, the electric connector assembly includes a connector socket (10), a connector socket fixing screw (25) and a fixed adjusting rubber pad (24); the connector socket (10) is cooperatively connected to a plug (11) on the LED bulb, a three-hole flange is provided to the connector socket (10), the connector socket is fixed with the heat conductive converting plate (27) through the three-hole flange and the connector socket fixing screw (25), and the fixed adjusting rubber pad (24) is further provided between the flange and the heat conductive converting plate (27) to ensure tightness of a waterproof surface; when the LED bulb (102) is installed, electrical connection of the LED bulb is achieved as long as the connector plug (11) is in butt joint with the connector socket (10) and the LED bulb (102) is fixed; a conducting wire led out from the connector socket (10) is guided to a power supply and a control circuit through the spool (108).

* * * * *